US005921156A

United States Patent [19]

Takezaki et al.

[11] Patent Number: 5,921,156

[45] Date of Patent: Jul. 13, 1999

[54] SCREW DRIVING AND TURNING MACHINE

[75] Inventors: Mitsugu Takezaki; Yoshio Fukushima; Noboru Ishikawa; Takeo Fujiyama; Hiroshi Tanaka; Kazuhiko Kuraguchi; Shinobu Iino, all of Tokyo, Japan

[73] Assignee: The Max Co., Ltd., Tokyo, Japan

[21] Appl. No.: 08/752,382

[22] Filed: Nov. 20, 1996

[30] Foreign Application Priority Data

| | | | |
|---|---|---|---|
| Nov. 20, 1995 | [JP] | Japan | 7-325101 |
| Nov. 20, 1995 | [JP] | Japan | 7-325102 |
| Nov. 20, 1995 | [JP] | Japan | 7-325103 |
| Nov. 20, 1995 | [JP] | Japan | 7-325106 |
| Apr. 25, 1996 | [JP] | Japan | 8-128975 |

[51] Int. Cl.[6] ..... B25B 23/04

[52] U.S. Cl. ..... 81/57.13; 81/433; 81/434; 81/435

[58] Field of Search ..... 81/57.11, 57.13, 81/57.14, 57.37, 431, 433–435, 54, 57, 52, 429

[56] References Cited

U.S. PATENT DOCUMENTS

| | | | |
|---|---|---|---|
| 1,694,284 | 12/1928 | Santa Ana . | |
| 2,713,165 | 7/1955 | Campbell et al. . | |
| 2,993,208 | 7/1961 | Cast et al. . | |
| 3,040,327 | 6/1962 | Michel . | |
| 3,056,137 | 10/1962 | Wandel et al. . | |
| 4,370,906 | 2/1983 | Gurries | 81/464 |
| 4,581,964 | 4/1986 | Takatsuru | 81/434 X |
| 4,774,863 | 10/1988 | Geist | 81/433 X |
| 5,207,127 | 5/1993 | Nick | 81/54 |
| 5,231,902 | 8/1993 | Uno et al. | 81/57.37 X |
| 5,687,624 | 11/1997 | Tsuge et al. | 81/57.37 X |

FOREIGN PATENT DOCUMENTS

| | | |
|---|---|---|
| 0 591 096 | 4/1994 | European Pat. Off. . |
| 1 065 699 | 1/1967 | United Kingdom . |
| 1 262 073 | 2/1972 | United Kingdom . |
| 2 271 523 | 4/1994 | United Kingdom . |

*Primary Examiner*—D. S. Meislin
*Attorney, Agent, or Firm*—Morgan, Lewis & Bockius LLP

[57] ABSTRACT

A screw driving and turning machine comprises: a body having a nose portion; a driving cylinder received in the body; a screw driving mechanism having a driving piston having a driving and turning bit slidably accommodated in the driving cylinder, wherein compressed air is fed into the driving cylinder to drive the driving piston, and a screw held in the nose portion of the body is driven to a state in which a head portion of the screw is raised; a screw turning mechanism having an air motor driven by a portion of compressed air fed to the driving cylinder, for turning the screw, which has been driven by the driving piston; a stop valve for opening and closing an air passage between the driving cylinder and the air motor, arranged in the middle of the air passage; and a contact arm slidably arranged along the nose portion, for operating the stop valve by being pushed to the body in accordance with pressing an end of the contact arm against a material into which the screw is driven, wherein the feed of compressed air from the driving cylinder to the air motor is stopped by closing the stop valve when the contact arm is pushed to a predetermined position by pressing an end of the contact arm against the material into which the screw is driven.

8 Claims, 22 Drawing Sheets

SCREW DRIVING AND TURNING MACHINE

BACKGROUND OF THE INVENTION

The present invention relates to a screw driving and turning machine by which a screw is driven and then turned to.

In general, the screw driving and turning machine is a type of nailing machine, which includes a driving mechanism to drive a screw and a turning mechanism to turn the screw after driving. Concerning the screw turning mechanism, a conventional mechanism is well known in which a screw, which has been driven by a driver, is turned by the driver being driven by an air motor.

As shown in FIG. 19 in which a conventional structure is illustrated, as a guide means for guiding the screw 30 to be driven, there is provided a guide chuck 231 to guide an end portion of the screw 230 to be driven. In this arrangement, reference numeral 232 is a contact arm.

As shown in FIG. 24(*a*), the driver 330 is screwed and fixed to the driving piston 331. Alternatively, as shown in FIG. 24(*b*), the driver 330 is attached into a central hole of the driving piston 331 via the bearing 332.

However, according to the above system in which the time to turn off an air motor switch is determined by an operator who uses his head, the depth of screw engagement is unstably varied. Not only that, the above construction wastes the compressed air.

Furthermore, the following problems may be encountered in the conventional guide mechanism. Since the conventional guide chuck 231 is attached to an end of the nose portion 233, the guide chuck 231 is simultaneously raised when the body is raised by a reaction force in the process of driving. Therefore, an end portion of the bit 234 tends to shift from a groove of the head of the screw 230. As a result, the end portion of the bit 234 is disengaged from the groove, which causes a failure in turning the screw.

However, in either case described above, it is impossible to disassemble the driving piston 331 and the driver 330. Therefore, it is impossible to replace only the driver 330 when the driver 330 has worn away. In the former structure, in the case of a driving and turning machine, the driver 330 is turned together with the driving piston 331 after the completion of driving, and in the process of driving, a lower end of the driving piston 331 is pressed against the bumper 334 by the action of compressed air that has been fed into the driving cylinder 333, and further an upper end of the driver 330 is pressed against the driving piston 331, so that an intensity of rotational resistance is high with respect to the driving piston 331 and the driver 330. Therefore, it is necessary to increase an intensity of rotational drive force. On the other hand, in the latter case, the driver itself is turned, however, the structure becomes complicated and the manufacturing cost is raised. Further, since the driver 330 is integrally fixed to the piston 331 via the bearing 332, it is not easy to replace the driver 330.

SUMMARY OF THE INVENTION

The present invention has been accomplished to solve the above problems. It is an object of the present invention to provide a mechanism for adjusting the depth of screw engagement by which the depth of screw engagement can be adjusted when the time to stop the operation of an air motor is variably adjusted.

It is another object of the present invention to provide a contact arm mechanism of a screw driving and turning machine, the entire length of which is not extended by dividing the contact arm into two portions.

It is still further object of the present invention to provide a screw guide mechanism capable of positively guiding a screw even when the body of the screw guide mechanism is raised by a reaction force generated in the process of driving.

It is still further object of the present invention to provide a piston structure of a pneumatic nailing machine wherein the driving piston and the driver can be disassembled from each other and the rotational resistance of the driver can be reduced when it is turned.

The present invention is to provide a mechanism for adjusting the depth of screw engagement in a screw driving and turning machine, the screw driving and turning machine having a screw driving mechanism in which a driving piston having a driving and turning bit is slidably accommodated in a driving cylinder provided in a body, wherein compressed air is fed into the driving cylinder to drive the driving piston so that a screw to be driven held in a nose portion provided at an end of the body can be driven to a state in which a head portion of the screw is raised, and the screw driving and turning machine also having a screw turning mechanism to turn the screw, which has been driven by the driving piston, by an air motor driven by a portion of compressed air fed to the driving cylinder, the mechanism for adjusting the depth of screw engagement comprising a stop valve for opening and closing an air passage between the driving cylinder and the air motor, arranged in the middle of the air passage, wherein the stop valve is operated by a contact arm slidably arranged along the nose portion, the contact arm is pushed to the body side when an end of the contact arm is pressed against a material into which the screw is driven, the feed of compressed air from the driving cylinder to the air motor is stopped by closing the stop valve when the contact arm is pushed to a predetermined position by pressing an end of the contact arm against the material into which the screw is driven.

Preferably, the mechanism for adjusting the depth of screw engagement further comprising an adjusting means for adjusting a distance between the contact arm and the stop valve, the adjusting means being arranged between the contact arm and the stop valve.

According to another aspect of the invention, there is provided a contact arm mechanism of a screw driving and turning machine having a driving mechanism for driving a screw to be driven, fed to a shooting section, downward tow a material to be screwed and also having a screw turning mechanism for turning the screw to be driven after the completion of driving so as to turn the screw to be driven into the material to be screwed, the contact arm mechanism being capable of sliding along the shooting section in a direction of driving, wherein the contact arm is pushed in a direction so that a lower end of the contact arm can protrude to a position more distant than an end of the shooting section from which the screw is driven, an upper end of the contact arm is moved to a position at which a starting operation of a trigger lever can be made effective when the lower end of the contact arm is pushed against the material to be screwed, the contact arm is divided into two portions including an upper arm portion and a lower arm portion, a movement of the contact arm is divided into a first stage movement in which the contact arm is pushed against the material to be screwed so that the trigger lever operation can be made effective and also divided into a second stage movement in which the screw turning mechanism is stopped, and the upper and the lower arm are integrally moved in the first stage movement and only the lower arm is moved in the second stage movement.

According to further aspect of the invention, there is provided a screw guide mechanism of a screw driving and turning machine, the screw driving and turning machine having a screw driving mechanism in which a driving piston having a driving and turning bit is slidably accommodated in a driving cylinder provided in a body, wherein compressed air is fed into the driving cylinder to drive the driving piston so that a screw to be driven held in a nose portion provided at an end of the body can be driven, and the screw driving and turning machine also having a screw turning mechanism to turn the screw, which has been driven by the driving piston, by an air motor.

The screw guide mechanism comprising: a contact arm slidably arranged along the nose portion, the contact arm being pushed to the body side when an end of the contact arm is pressed against a material into which the screw is driven; a guide chuck to guide the screw to be driven accommodated in the nose portion, in the extending direction of the bit; and a contact portion coming into contact with the material into which the screw is driven, at a position on the end side more distant than the guide chuck.

According to still further aspect of the invention, there is provided a piston structure of a pneumatic nailing machine comprising: a driving cylinder; a driving piston slidably accommodated in the driving cylinder so that it can be slid in the upward and downward direction; and a nailing driver attached to the driving piston, wherein compressed air is fed into the driving cylinder so as to drive the driving piston to drive a nail, the driving piston is composed of an upper and a lower piston member which are separable from each other, the nailing driver penetrates a center of the lower piston member, and a flange protruding outside from an upper end portion of the nailing driver is stationarily arranged between the upper and the lower piston member.

The pneumatic nailing machine may be a screw driving and turning machine in which a screw is driven by a bit instead of the above driver, and the bit may be arranged so that it can be freely turned round an axial center of the driving piston.

DETAILED DESCRIPTION OF THE PREFERRED EMBODIMENTS

Figure 1:
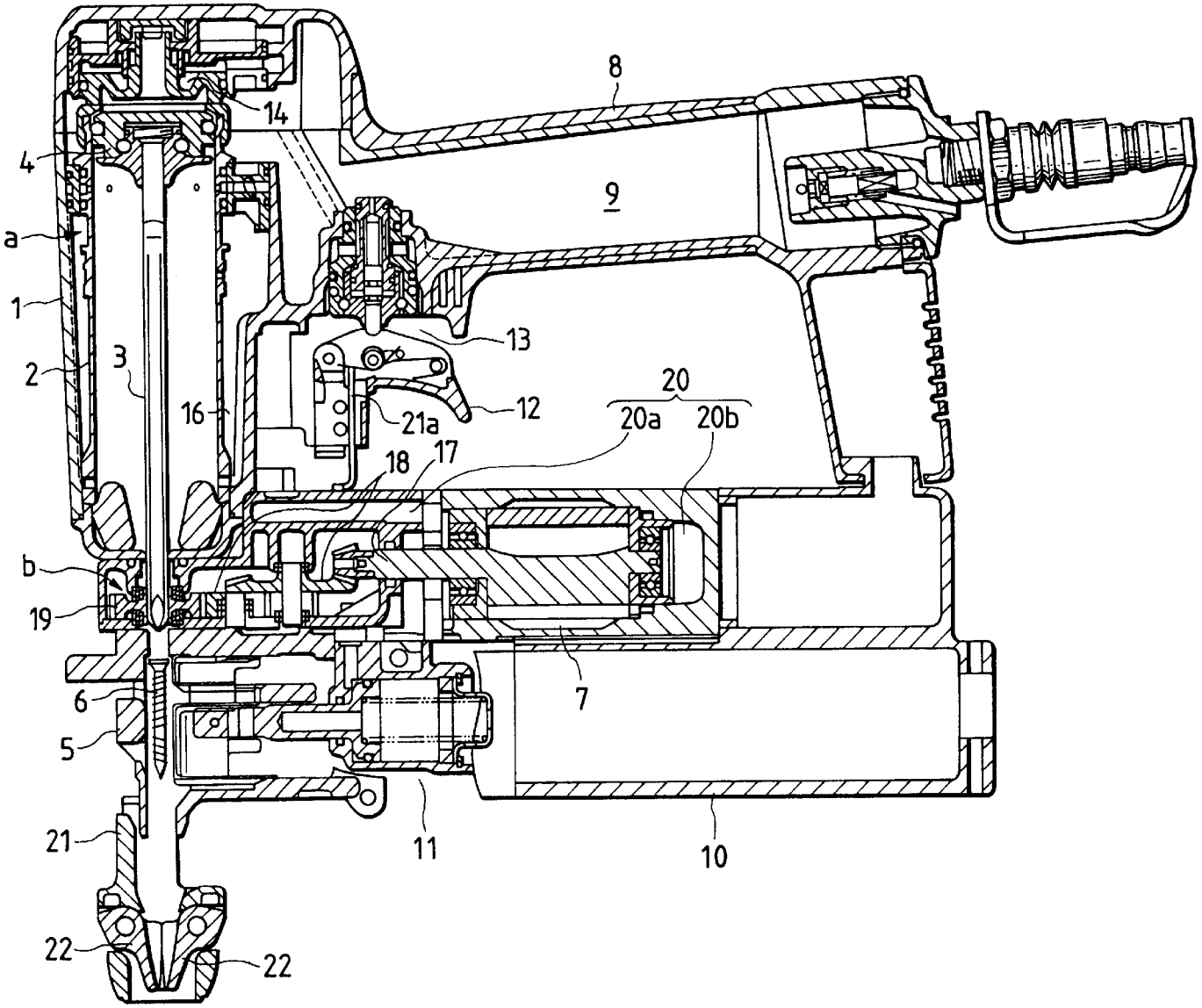
FIG. 1 is a longitudinal cross-sectional view of a driving and turning machine having the exhaust mechanism of the present invention.

FIG. 1 is an arrangement view showing a screw driving and turning machine. This driving and turning machine is composed as follows. In the driving cylinder 2 accommodated in the body 1, there is provided a driving piston 4 having a bit 3 used for driving and turning a screw, wherein the driving piston 4 is capable of sliding freely in the upward and downward direction in the driving cylinder 2. The driving piston 4 is driven when compressed air is fed into the driving cylinder 2. There is provided a screw driving mechanism "a" for driving the screw 6 in the nose portion 5 arranged at an end of the body 1, so that the screw is driven to a state in which a head portion of the screw 6 is raised. Also, there is provided a screw turning mechanism "b" for turning the screw 6, which has been driven by the above driving piston 4, by an air motor 7 driven by a portion of compressed air fed to the driving cylinder 2.

In this connection, compressed air is fed from a compressed air feeding source into the driving cylinder 2 via the air chamber 9 formed between the grip 8 and the body 1. The screws 6 to be driven are connected with each other via a connecting member and accommodated in the magazine 10 while the connected screws 6 are formed into a coil-shape. The screws 6 are fed into the nose portion 5 one by one by the screw feeding air cylinder 11.

Figure 2:
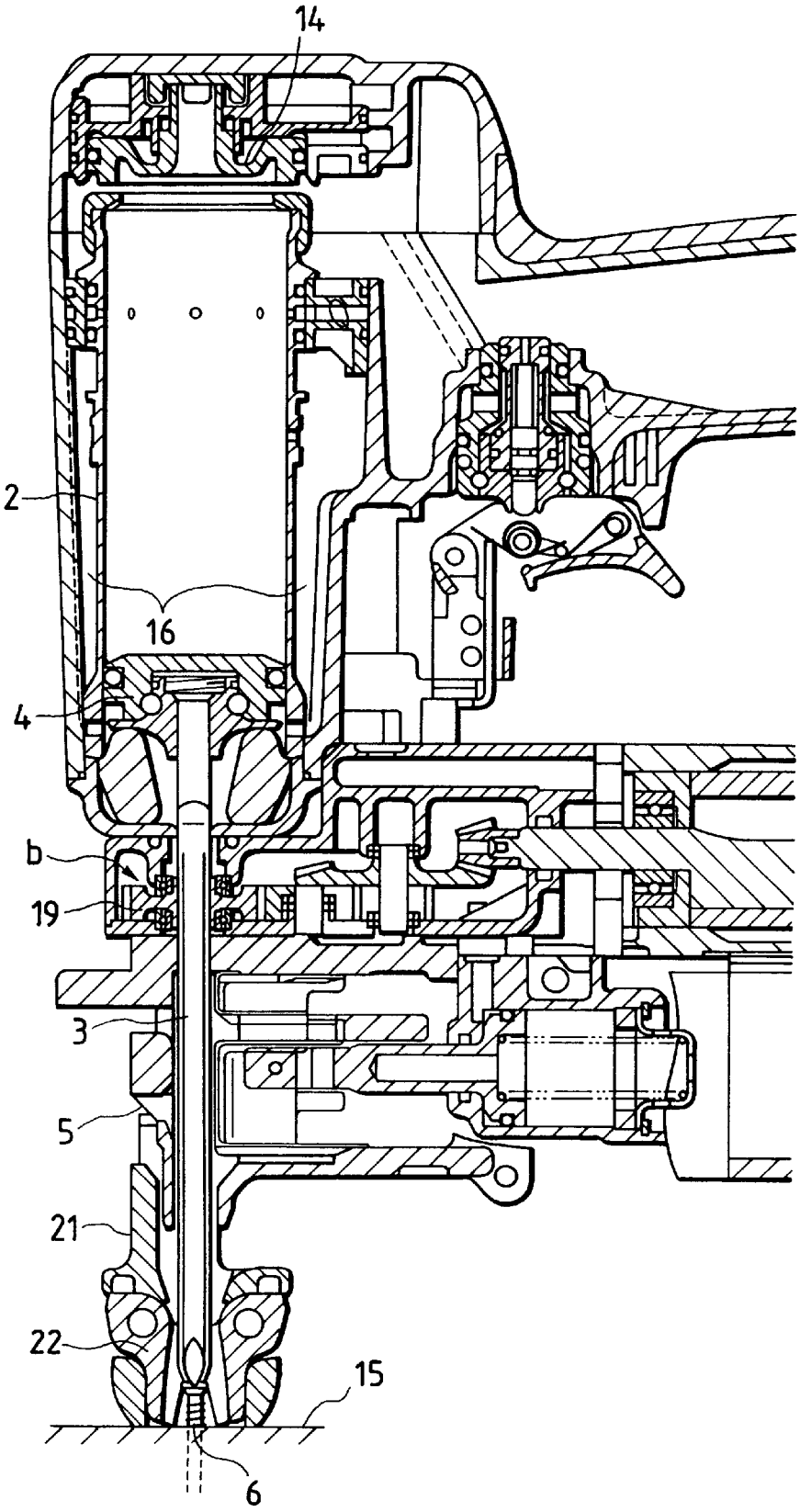
FIG. 2 is a cross-sectional view of the stop valve to stop the motor and the screwing depth adjusting mechanism.

The driving mechanism "a" is set in motion when the trigger lever 12 is pulled. That is, the operation is conducted as follows. The trigger valve 13 is operated by the trigger lever 12. As shown in FIG. 2, the head valve 14 is opened upward being linked with the trigger valve 13, so that the compressed air of high pressure in the air chamber 9 is instantaneously fed into the driving cylinder 2 so as to drive the driving piston 4. One portion of the screw 6 driven by the driving mechanism "a" is driven into a material 15 to be driven, and the other portion of the screw 6 is left outside the material. Further, the screw 6 is turned by the screw turning mechanism "b".

On the other hand, when the trigger lever 12 is released, the trigger valve 13 is operated, so that the head valve 14 closes again the air chamber 9 of the driving cylinder 2 and opens the exhaust port as shown in FIG. 1. Accordingly, the pressure acting on an upper surface of the driving piston 4 is reduced, and the pressure acting on a lower surface of the driving piston 4 is raised by the action of the compressed air stored in the blow-back chamber 16 which was compressed by the driving piston 4 in the process of driving. Since a differential pressure between the upper and the lower surface of the driving piston 4 is reversed in this way, the driving piston 4 returns to the upper dead point.

The screw turning mechanism "b" operates as follows. Turn of the output shaft 17 of the air motor 7 is transmitted to the drive gear 19 via the intermediate gear 18. Therefore, it is possible to turn the bit 3 which is inserted into a non-circular through-hole formed at the center of the drive gear 19. The air motor 7 and the driving cylinder 2 are connected with each other by an air passage 20, and the air motor 7 is turned by the action of compressed air fed into the driving cylinder 2. The air passage 20 is composed in such a manner that it is communicated with the air introducing section 20*b* of the air motor 7 via the air passage 20*a*. Accordingly, after the driving mechanism "a" has been operated, the screw turning mechanism "b" is set in motion by the action of compressed air fed from the air passage 20, so that the screw to be driven into the material 15 can be turned in the state shown in FIG. 2. In this connection, the bit 3 can be slid freely with respect to the drive gear 19 in the axial direction and turned together with the drive gear 19.

Reference numeral 21 is a contact arm. This contact arm 21 is capable of sliding along the nose portion 5. When an end portion of the contact arm 21 is pressed against the material 15 into which the screw is driven, the contact arm 21 is pushed to the body 1 side. In other words, the contact arm 21 relatively moves upward. When the contact arm 21 is pushed in, an upper end of the contact arm 21 moves upward, so that a pulling operation of the trigger lever 12 can be made effective, that is, the trigger valve 13 can be made to operate. In this way, the safety device of the trigger valve 13 can be composed in the same manner as that of a common nailing machine. At the lower end of the contact arm 21, there are provided guide chucks 22 for the screw 6 to be driven.

In addition to the function as a safety device, this contact arm 21 has the following function. In order to prevent the entire screw from being driven into the material 15 in the process of driving, this contact arm 21 stops the end of the bit 3 at an upper position on the surface of the material 15 into which the screw 6 is driven, so that the head portion of the screw 6 can be upheld in a rising state in which the head portion rises from the surface of the material 15. In order to accomplish the above object, the contact arm 21 is composed in such a manner that it can be slid along the nose portion 5 in two stages. At an end of the movement of the first stage, there is provided a lock mechanism (not shown) to lock the contact arm 21 so that the safety device can be released at the first stage and the screw can be driven in a state in which the head portion of the screw is raised from the surface of the material (shown in FIG. 2). When the lock mechanism is released after the completion of driving, it becomes possible for the contact arm 21 to move in the second stage. In this way, the screw 6 can be screwed into the material.

In this connection, in the movement of the contact arm 21 in the second stage, the moving direction of the contact arm 21 is reverse to the moving direction of the screw 6 to be driven, however, the distance of movement of the contact arm 21 is the same as the distance of movement of the screw 6 to be driven. That is, when the screw 6 is screwed into a predetermined depth, the contact arm 21 is set at a predetermined position. Accordingly, there is provided a motor stopping mechanism by which the operation of the air motor 7 is stopped so that the depth of screw engagement of the screw 6 can be maintained at a constant value when the contact arm 21 has reached this predetermined position.

Figure 3:
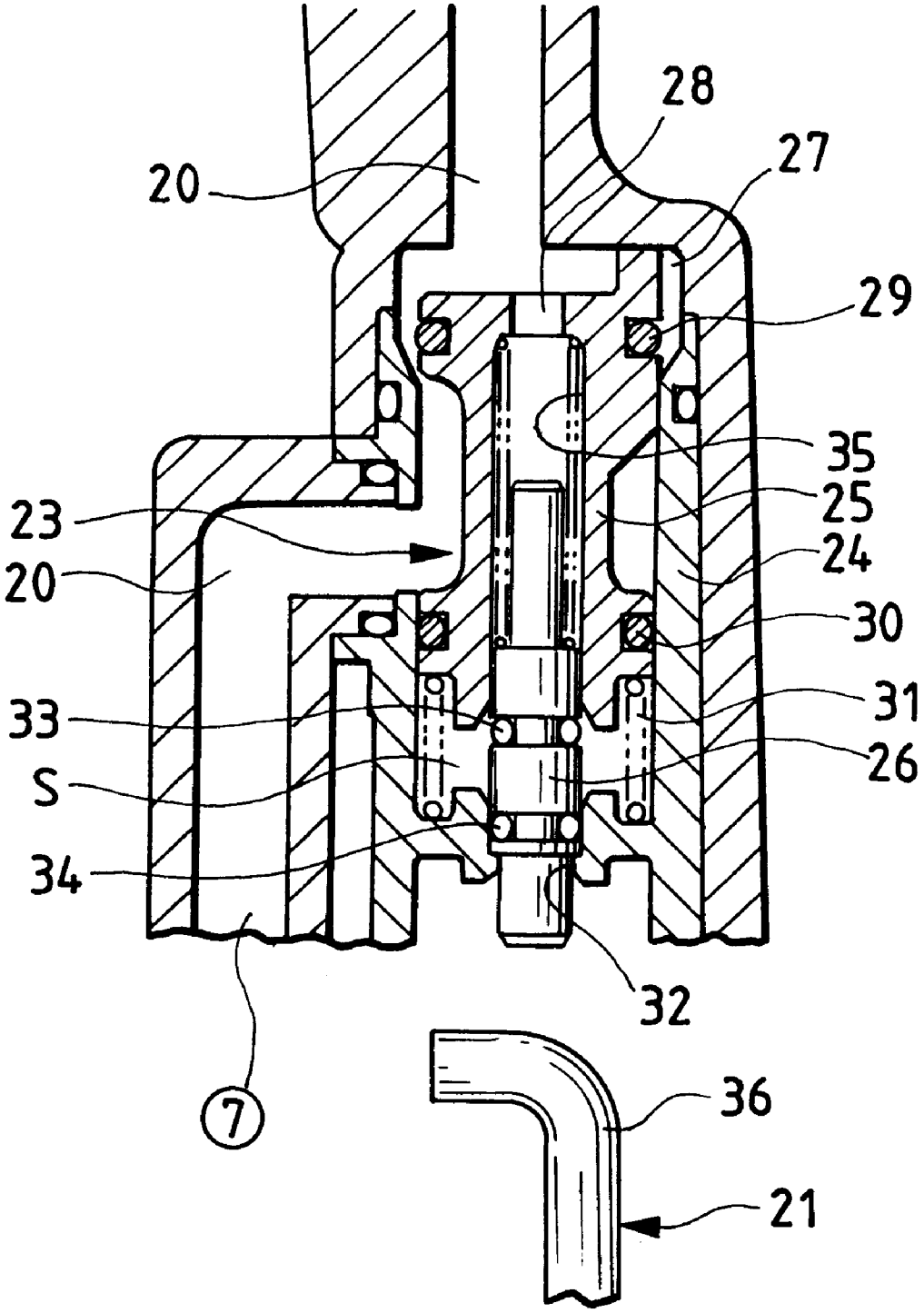
FIG. 3 is a schematic illustration showing the section of the stop valve according to the invention.
Figure 4:
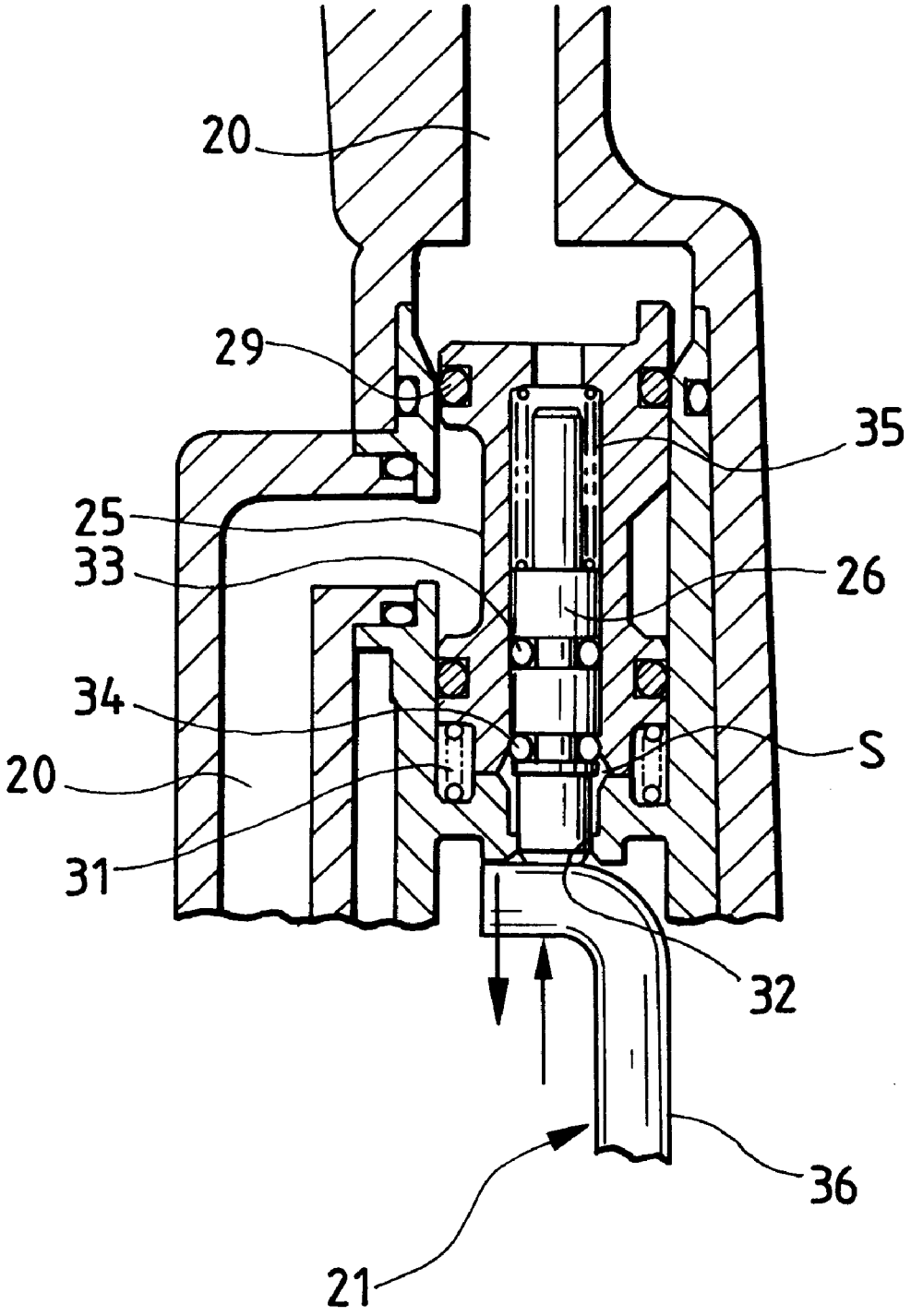
FIG. 4 is a schematic illustration showing the operating condition of the stop valve.
Figure 5:
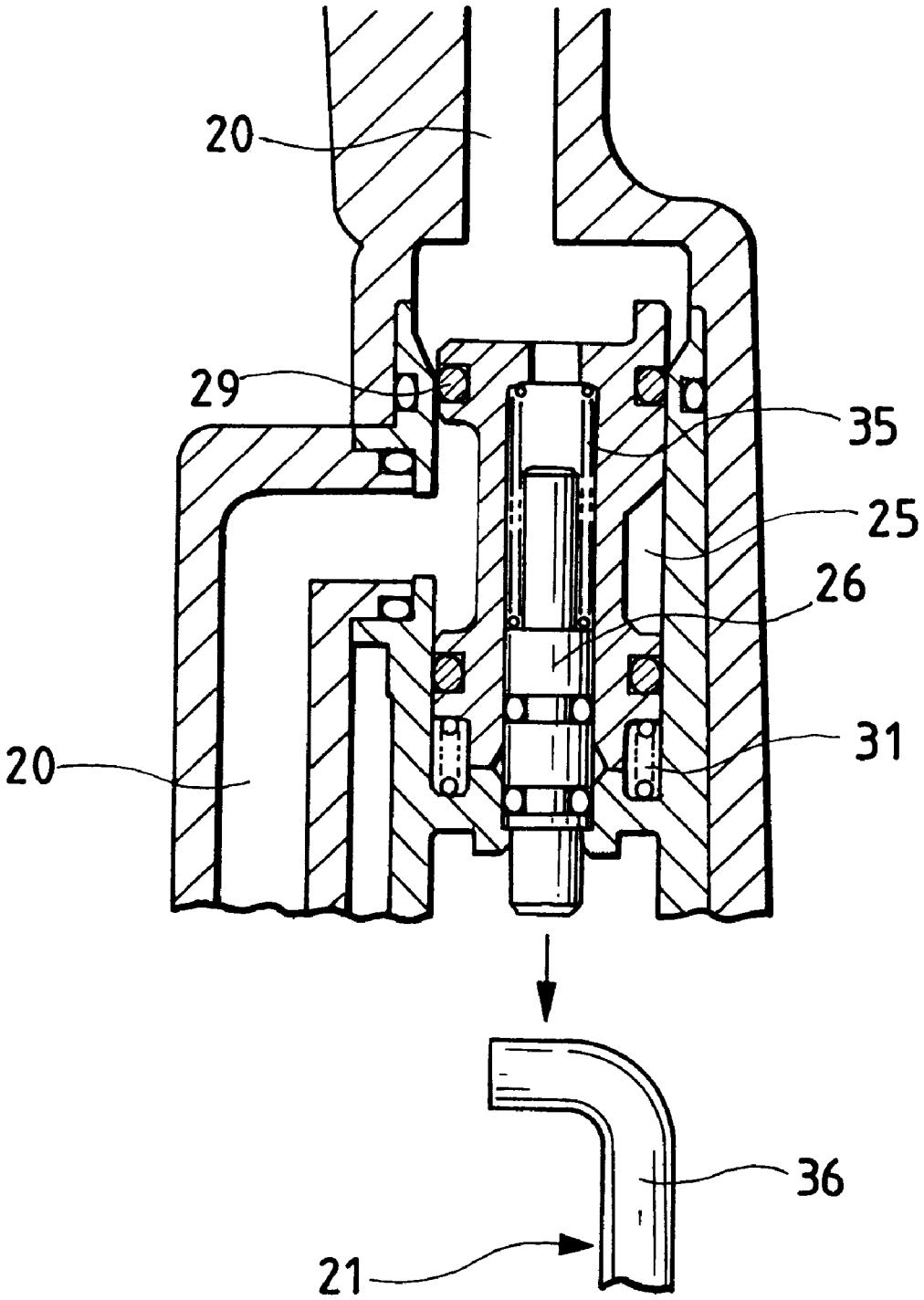
FIG. 5 is a schematic illustration showing the operating condition of the stop valve when the contact arm is released.

As shown in FIG. 3, this stopping mechanism is composed as follows. There is provided a stop valve 23 for opening and closing an air passage 20, in the middle of this air passage 20 which connects the driving cylinder 2 with the air motor 7. An upper portion of the stop valve 23 is communicated with the air passage 20 which is connected to the driving cylinder 2. This stop valve 23 includes: a valve cylinder 24, the side portion of which is communicated with the air passage 20 connected to the air motor 7; a cylindrical pilot valve 25 having a bottom slidably accommodated in the valve cylinder 24; and a valve stem 26 slidably accommodated in a lower portion of the valve cylinder 24. In an upper portion of the valve cylinder 24, there is formed a large diameter portion 27, the inside diameter of which is large. An upper end portion of the pilot valve 25 is closed. In the upper end portion of the pilot valve 25, there is formed a communicating hole 28 which is open to the air passage 20. There are provided O-rings 29, 30 in the upper and the lower portion of the pilot valve 25. The pilot valve 25 is pushed upward by the spring 31 at all times, that is, the pilot valve 25 is pushed to a position at all times where the air passage 20 is opened. An upper portion of the valve stem 26 is arranged at a position a little inside the lower end of the pilot valve 25, and a lower portion of the valve stem 26 is protruded from an opening 32 formed at the bottom portion of the valve cylinder 24. In the upper and the lower portion, there are provided O-rings 33, 34. The valve stem 26 is pushed downward by the spring 35 at all times. The contact arm 21 includes a pushing piece 36 opposed to the lower end portion of the valve stem 26. Accordingly, when the contact arm 21 is moved to a predetermined position, the valve stem 26 is pushed in by the pushing piece 36.

Usually, the lower end portion of the valve stem 26 protrudes to a position lower than the valve cylinder 24, and the pilot valve 25 is located at a position higher than the spring 31. Due to the above arrangement, the air passage 20 of the driving cylinder 2 is open as shown in FIG. 3. The air passage 20 communicating with the driving cylinder 2 is connected with the inside of the pilot valve 25 via the communicating hole 28 formed at the upper end of the pilot valve 25. Further, the air passage 20 is communicated with a lower portion of the pilot valve 25 via a space formed between the lower end portion of the pilot valve 25 and the upper end portion of the valve stem 26. Accordingly, while the driving mechanism "a" is operated when the driving and turning machine is set in motion by pressing the end of the contact arm 21 against the material 15 into which the screw is driven and also while the screw turning mechanism "b" is successively operated, the compressed air discharged from the driving cylinder 2 fills the inside of the pilot valve 25 and its lower space S.

When the contact arm 21 is separated from the material 15 after the completion of screwing, the valve stem 26 is returned to a lower initial position by the action of the spring 35. However, since the pilot valve 25 is also moved downward, the sealing condition of the O-ring 29 in the upper portion of the valve stem 26 is not changed. Therefore, the pilot valve 25 is not returned. For this reason, the air motor 7 is maintained in a stopping state.

After that, the trigger lever 12 is released and the compressed air is discharged from the driving cylinder 2, the compressed air in the air passage 20 is also discharged. Accordingly, air pressure acting on the upper surface of the pilot valve 25 is released, so that the pilot valve 25 is returned to the initial position shown in FIG. 3 by the action of the spring. Due to the foregoing, the air passage 20 is opened again, and preparations are made for the next starting and sopping operation of the air motor 7.

As described above, the distance of movement of the contact arm 21 in the process of screwing is the same as the distance of movement of the screw 6 to be turned. Accordingly, it is possible to detect the depth of screw engagement of the screw 6 by detecting the movement of the contact arm 21. The stopping mechanism of the air motor 7 utilizes the above principle. When the contact arm 21 is moved to a predetermined position, the operation of the air motor 7 is stopped. Due to the foregoing, it is possible to stop the screw 6 at a predetermined screwing depth. Therefore, the screwing depth can be always maintained constant, and the fastening strength of the screw can be stabilized, and further the compressed air can be effectively utilized and not wasted.

FIGS. 6 to 10 show an adjusting means 37 according to the invention applied to the screw driving and turning machine.

Figure 6:
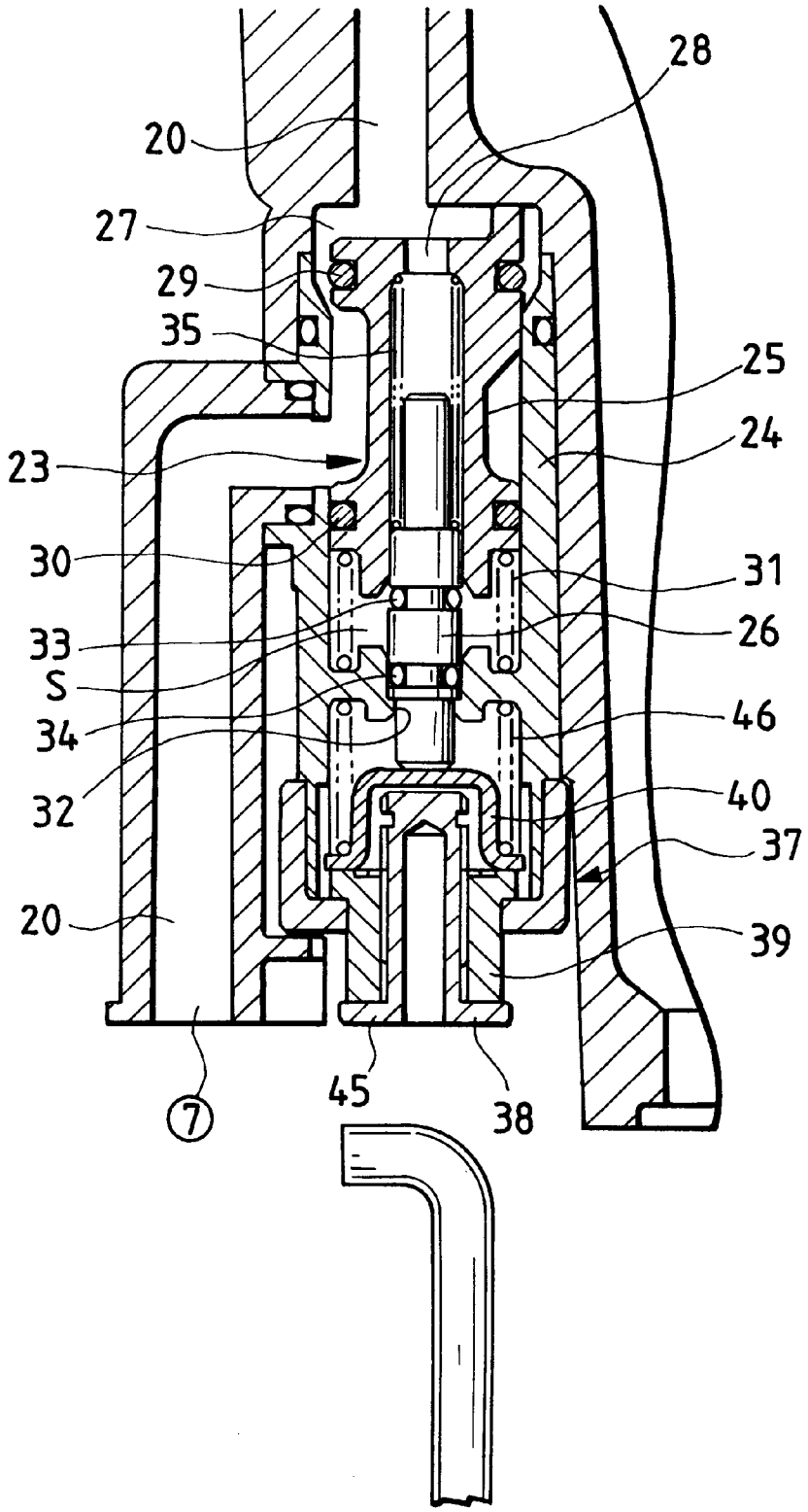
FIG. 6 is a schematic illustration showing the sections of the stop valve and the screwing depth adjusting mechanism.
Figure 10:
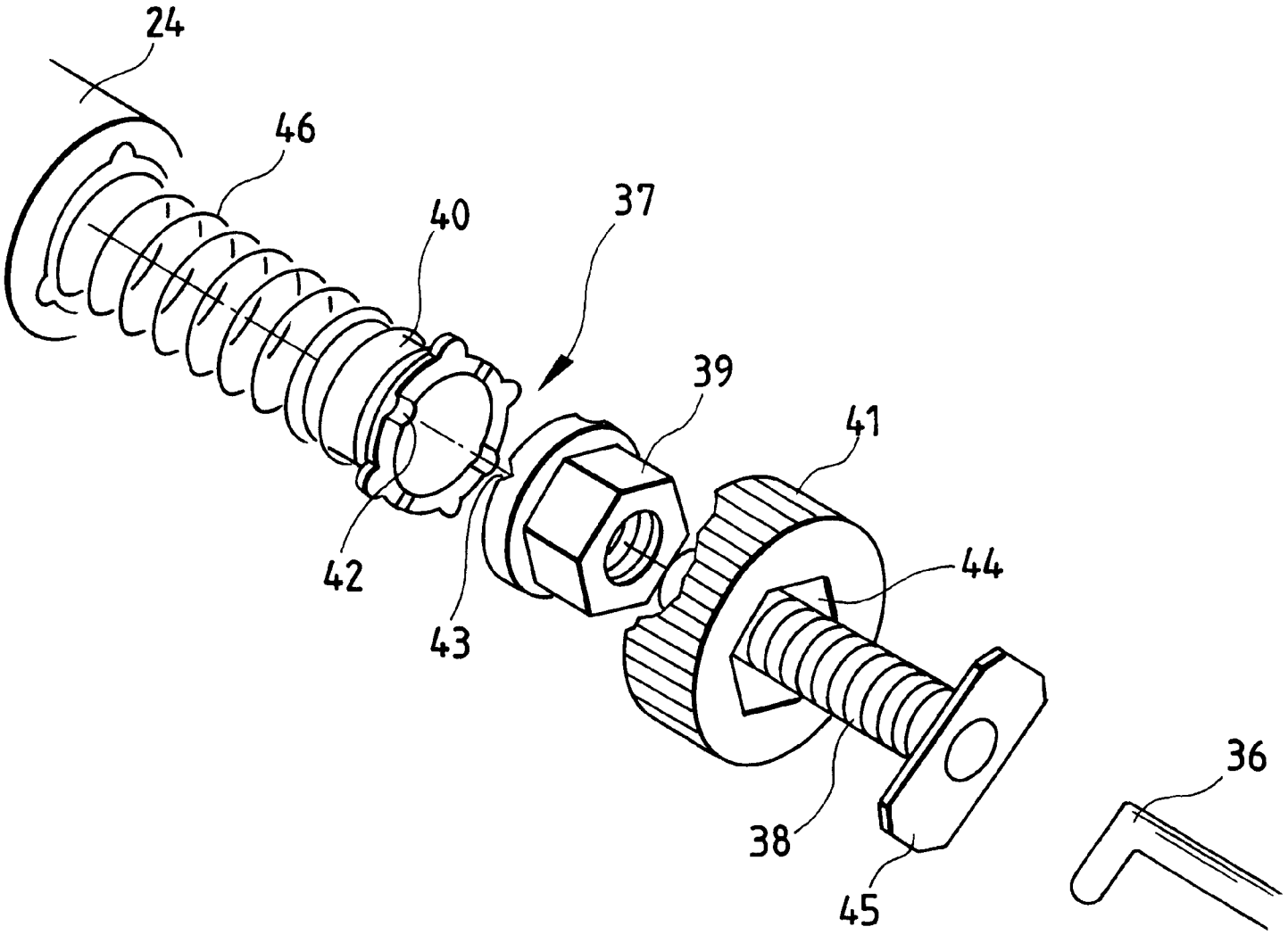
FIG. 10 is an exploded perspective view showing the screwing depth adjusting mechanism.

The adjusting means 37 provided between the contact arm 21 and the valve stem 26 of the stop valve 23, for adjusting a clearance between the contact arm 21 and the valve stem 26. As shown in FIGS. 6 and 10, this adjusting means 37 is composed as follows. An adjusting nut 39 is screwed to an adjusting bolt 38. There is provided a cup 40 above the adjusting nut 39, and a dial 41 is engaged with the outside of the adjusting nut 39. The cup 40 is arranged at a lower position of the valve stem 26 and accommodated in the valve cylinder 24 so that the cup 40 can not be turned. On a lower surface of the cup 40, there is formed an engaging protrusion 42, and on an upper surface of the adjusting nut 39, there is formed an engaging groove 43. When the engaging protrusion 42 and the engaging groove 43 are engaged a little with each other, the turn of the adjusting nut 39 is prevented. The outer circumferential surface of the adjusting nut 39 is formed into a polygon and engaged with a polygonal hole 44 formed at the center of the dial 41. At the same time, the adjusting nut 39 is held by the valve cylinder 24. At the lower end of the adjusting bolt 38, there is formed a receiving portion 45 to receive the contact arm 21. In this connection, the adjusting nut 39 is capable of turning round the axis and moving in the axial direction. Although the adjusting bolt 38 is not turned, it is capable of moving in the axial direction. The cup 40 is pushed downward by the spring 46.

Figure 7:
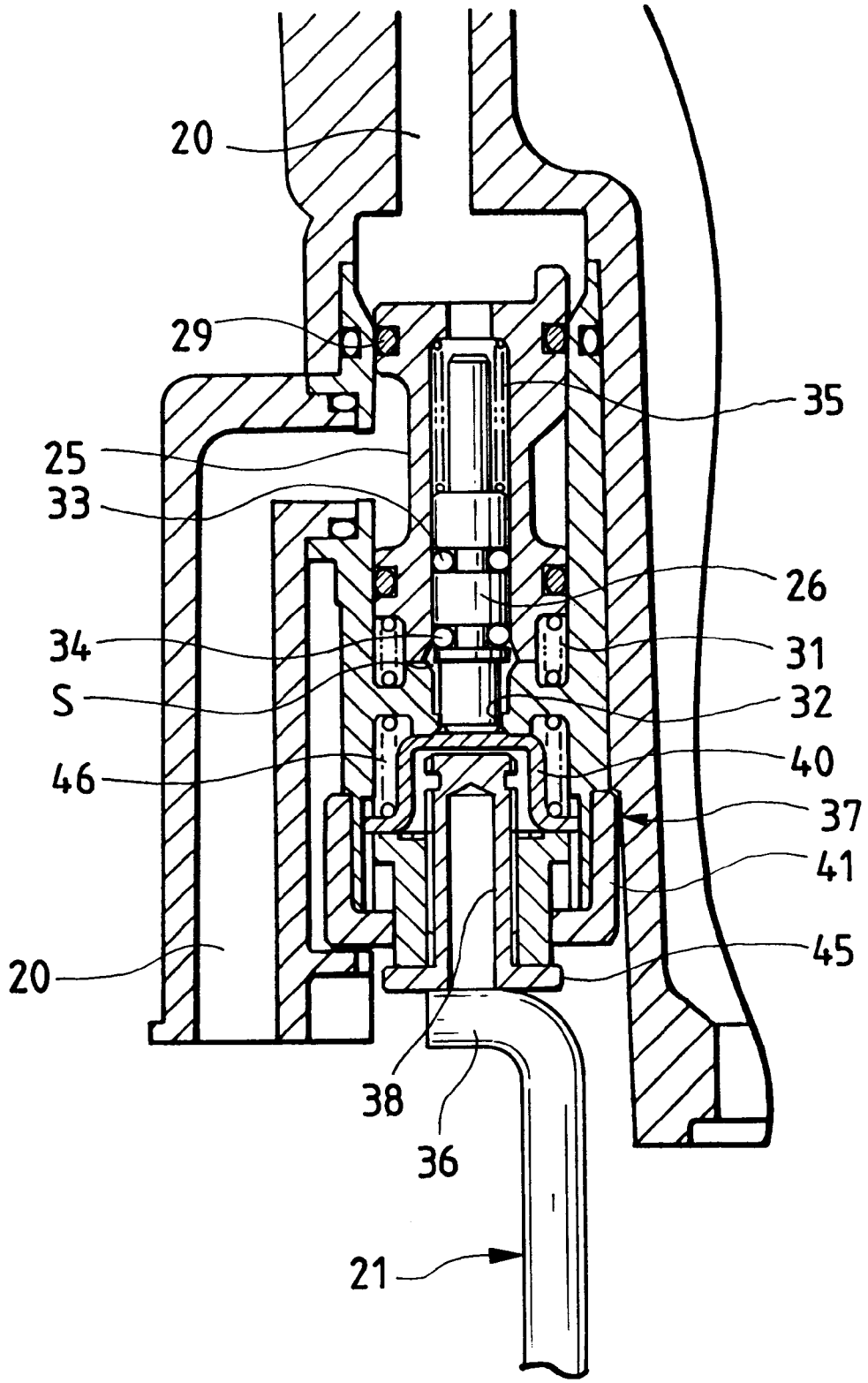
FIG. 7 is a schematic illustration showing the operating condition of the stop valve and the screwing depth adjusting mechanism.
Figure 8:
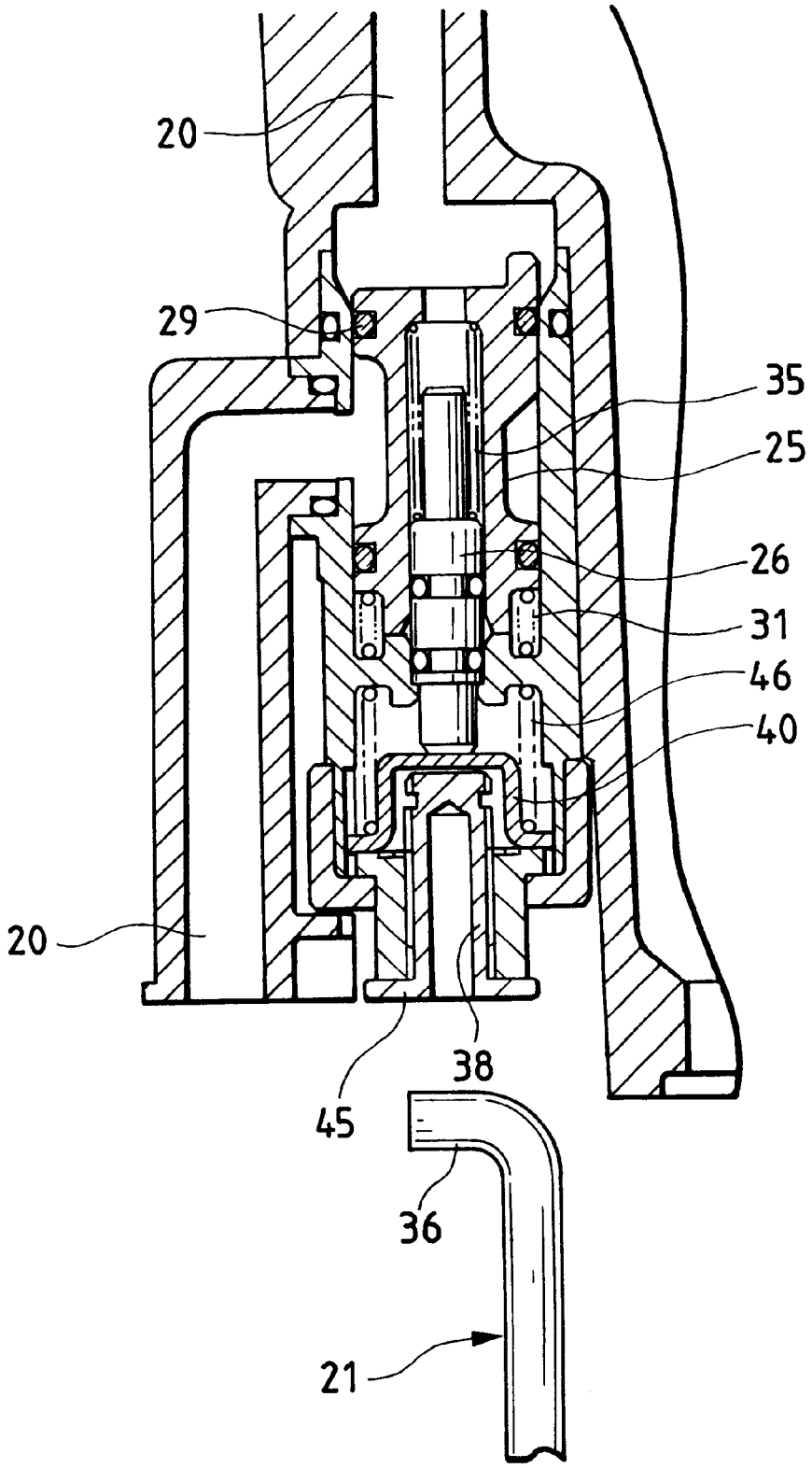
FIG. 8 is a schematic illustration showing the operating condition of the stop valve and the screwing depth adjusting mechanism when the contact arm is released.

When the screw 6 is sufficiently turned and screwed into the material by the screw turning mechanism "b", the contact arm 21 is pushed into a predetermined position. Then, as shown in FIG. 7, the pushing piece 36 of the contact arm 21 engages with and pushes up the receiving portion 45 of the adjusting bolt 38 of the adjusting means 37. Therefore, the cup 40 of the adjusting means 37 pushes the valve stem 26 while the adjusting means 37 resists a force generated by the spring 35. Accordingly, simultaneously when the O-ring 34 arranged at a lower position of the valve stem 26 is separated from the opening 32, the upper O-ring 33 is inserted into the pilot valve 25. Therefore, the lower space of the pilot valve 25 is communicated with the atmosphere and shut off from the air passage 20. Accordingly, the compressed air in the space S is discharged through the opening 32 into the atmosphere. Due to the foregoing, the differential pressure between the upper and the lower surface of the pilot valve 25 is reversed, and the pilot valve 25 is moved downward while it resists a force generated by the spring 25. At this time, the upper O-ring 29 comes into contact with the inside of the valve cylinder 24. Therefore, the air passage 20 is closed and the feed of compressed air from the driving cylinder 2 to the air motor 7 is stopped, so that the operation of the air motor 7 is also stopped. In this way, the screwing operation is stopped. In this connection, since the pilot valve 25 is instantaneously moved, the feed of compressed air is instantaneously stopped.

Figure 9:
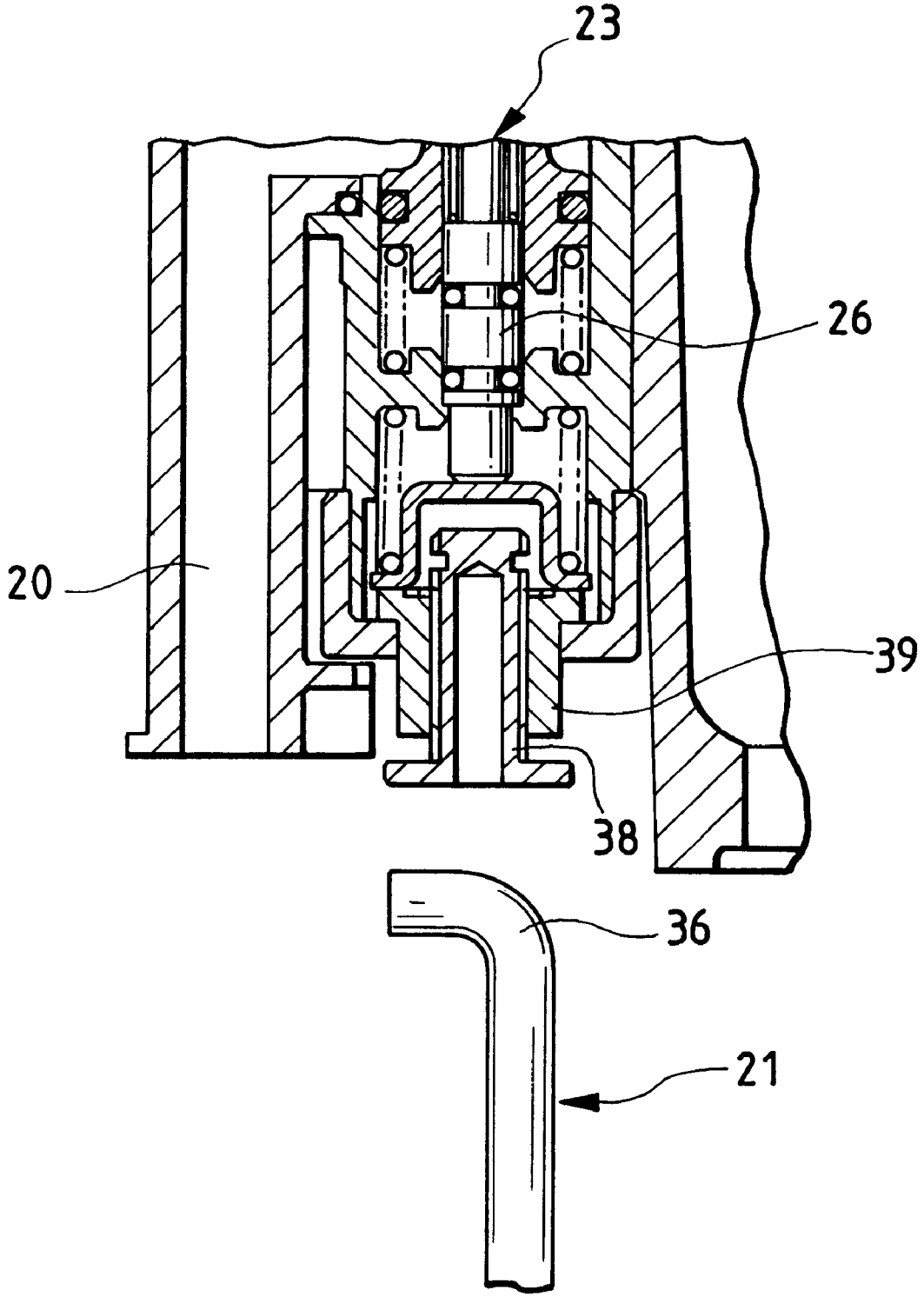
FIG. 9 is a schematic illustration showing the adjusting state of the screwing depth adjusting mechanism.

In this connection, as shown in FIG. 9, when the dial 41 of the adjusting means 37 is turned, the adjusting nut 39 is also turned, however, the adjusting bolt 38 is not turned. Therefore, the adjusting bolt 38 can be moved in the axial direction. Consequently, it is possible to adjust a clearance between the receiving portion 45 of the adjusting bolt 38 and the pushing piece 36 of the contact arm 21. When this clearance is adjusted in this way, it is possible to adjust the time at which the contact arm 21 pushes the valve stem 26 of the stop valve 23 so as to stop the operation of the air motor 7, that is, it is possible to adjust the time at which the screwing operation is completed. Accordingly, it is possible to adjust the screwing depth of the screw to be the most appropriate value.

Figure 11:
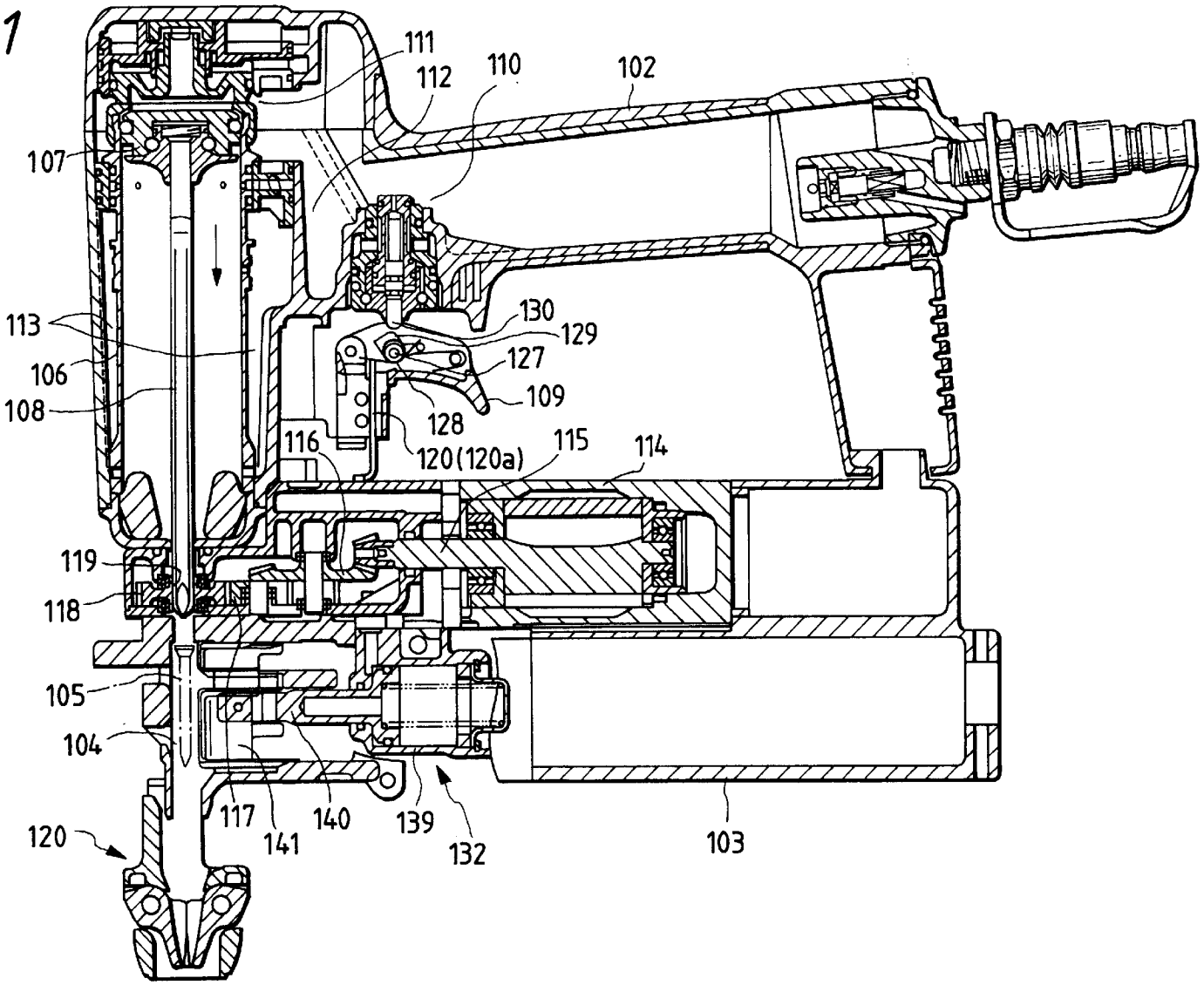
FIG. 11 is a longitudinal cross-sectional view of another screw driving and turning machine of the present invention.

FIG. 11 is another arrangement view of the screw driving and turning machine. This screw driving and turning machine includes a body 101, grip 102 and magazine 103. This screw driving and turning machine is arranged as follows. A screw 105 to be driven is fed from the magazine 103 to a shooting section 104 located in a lower portion of the body 101. The screw 105 to be driven, fed to the shooting section 104, is driven by a driving mechanism arranged in the body 101, so that a portion of the screw 105 to be driven can be driven into a material to be screwed. After that, the screw 105 to be driven is turned by a screw driving mechanism arranged in an upper portion of the magazine 103. In this way, the screw 105 to be driven can be screwed into the material.

The driving mechanism is operated to drive the screw 105 to be driven as follows. There is provided a driving piston 107 which is slidably arranged in a driving cylinder 106. A bit 108 for driving is integrally connected with this driving piston 107. In accordance with the starting operation of a trigger lever 109, a trigger valve 110 and a main valve 111 are operated, so that compressed air charged in an air chamber 112 is fed into the driving cylinder 106. By the action of this compressed air, both the driving piston 107 and the turning bit 108 are driven, and a screw 105 accommodated in the shooting section 104 can be driven.

In the process of driving, the air provided on a lower side of the driving piston 107 is compressed and fed to a blow-back chamber 113. When the trigger lever 109 is released, this compressed air moves the driving piston 107 upward and operates a cylinder unit used for feeding a screw at the same time. The above driving mechanism and other accompanying components such as various valves, a trigger lever and a cylinder for feeding a screw are well known and used in a conventional nailing machine.

A screw turning mechanism is composed as follows. An air motor 114 is used as a drive source. An output shaft 115 of the air motor 114 is connected with a bevel gear 116, which is connected with an intermediate gear 117. The intermediate gear 117 is meshed with a drive gear 118. There is formed a non-circular through-hole 119 at the center of the drive gear 118. The turning bit 108 is engaged with this non-circular through-hole 119 of the drive gear 118. Due to the above construction, by the rotation of the air motor 114, the turning bit 108 can be turned.

There is provided a contact arm 120 in the above screw driving and turning machine. The contact arm 120 is slidably arranged along the above shooting section 104 in the direction of driving a screw. The contact arm 120 is pushed so that a lower end of the contact arm can be protruded downward to a position more distant than a fore end of the shooting section 104. When the lower end of the contact arm is pressed against the material to be screwed, an upper end of the contact arm 120 can be moved to a position where the starting operation of the trigger lever 109 is made effective.

Figure 12:
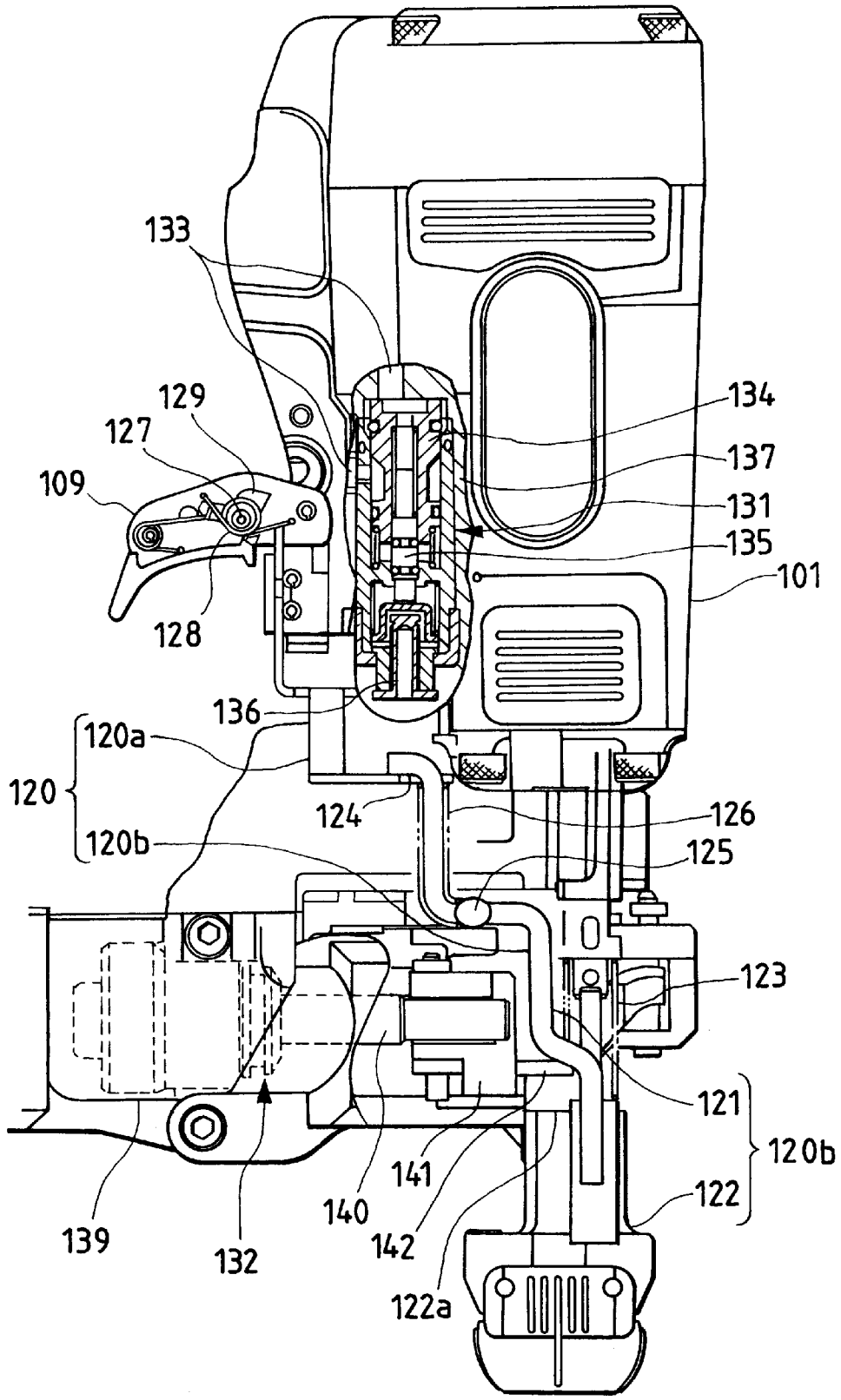
FIG. 12 is a schematic illustration showing a contact arm mechanism of the screw driving and turning machine of the present invention.

As shown in FIG. 12, the contact arm 120 is divided into two portions, that is, one is an upper arm portion 120*a*, and the other is a lower arm portion 120*b*. The upper arm portion 120*a* is a plate-shaped body which is bent in two stages. The lower arm portion 120*b* is composed of a rodshaped portion 121 bent in three stages, and a head portion 122 formed at a lower end of the rod-shaped portion 121. The head portion 122 protrudes to a position under the shooting section 104. The lower arm portion 120*b* is always pushed downward by the action of a first spring 123 arranged between the head portion 122 and the body 101. At a lower end of the upper arm 120*a*, there is formed an opening 124 through which an upper end of the lower arm 120*b* passes. There is provided a second spring 126 between the periphery of this opening 124 and a protrusion 125 formed in the middle of the lower arm 120*b*. By this second spring 126, the upper arm 120*a* is always pushed upward.

Figure 13:
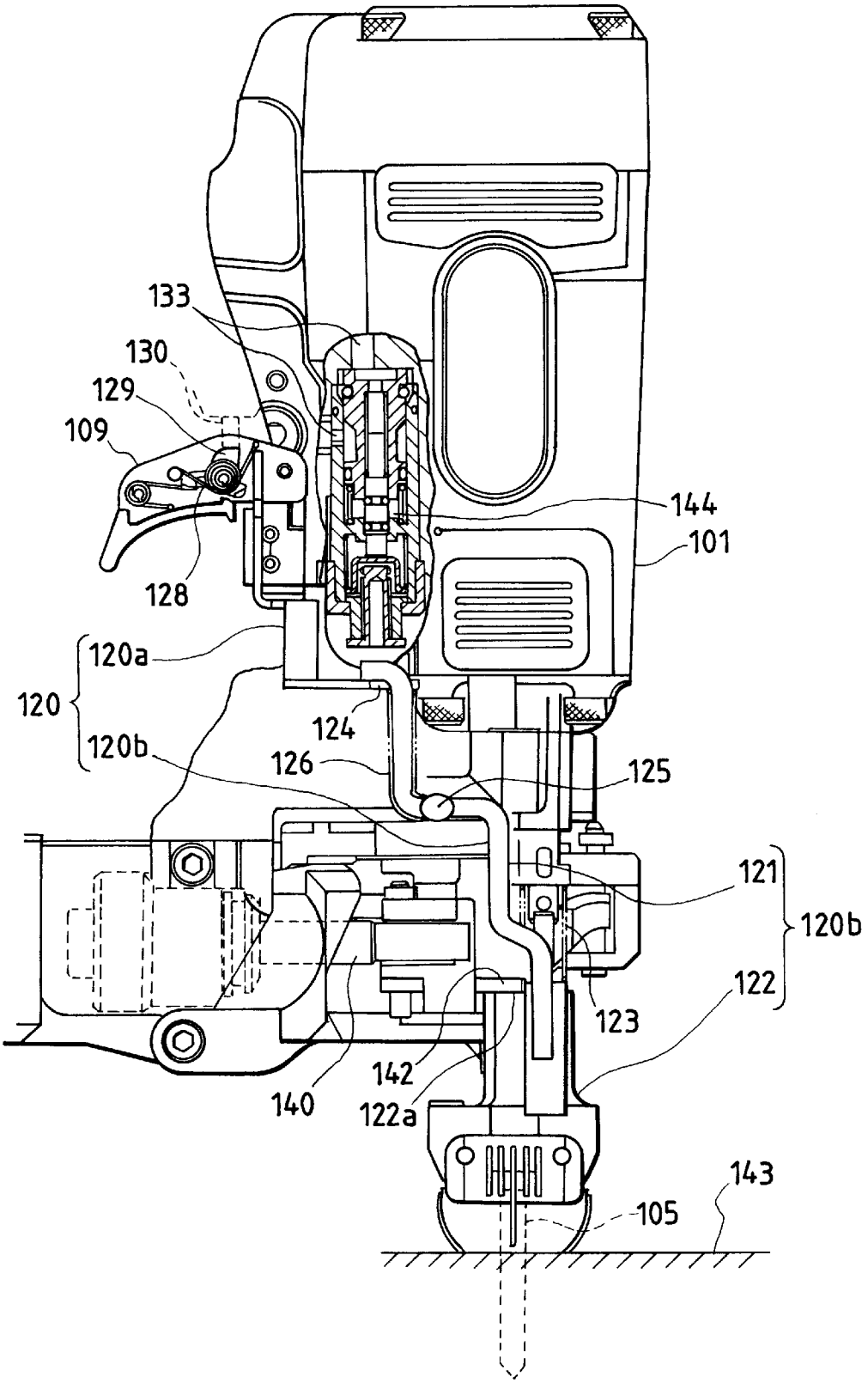
FIG. 13 is a schematic illustration showing the operation of the contact arm in the first stage movement.

The upper end portion of the upper arm 120*a* is engaged with one end of a helical spring 128 trained round a shaft 127 on the side of the trigger lever 109. The end of the helical spring 128 is engaged with an operation plate 129 rotatably attached to the above shaft 127. A portion of the outer periphery of the operation plate 129 is formed to be circular. Usually, as shown in FIGS. 11 and 12, an edge portion closest to the shaft 127 is opposed to a valve stem 130 of the trigger valve 110. In this case, even if the trigger valve 109 is pulled, it is impossible to push in the valve stem 130. Accordingly, the operation is not effective. On the other hand, when one end portion of the above helical spring 128 is pushed up, the operation plate 129 is turned so that an edge portion of the operation plate 129 most distant from the shaft 127 can be opposed to the valve stem 130 as shown in FIG. 13. Accordingly, when the trigger lever 109 is pulled so as to start the operation, the valve stem 130 can be effectively pushed in.

In this connection, there are provided a stop valve 131 and a screw feeding cylinder unit 132 which are related to the operation of the contact arm 120.

The stop valve 131 is arranged at a position above the lower arm portion 120*b* and in the middle of an air passage 133 to feed compressed air to the air motor 114. In the stop valve 131, there are provided a valve 134 to open and close the air passage 133, and a valve stem 135 to open and close the valve 134. In the stop valve 131, there is also provided a push button 136 operated together with the valve stem 135. The push button 136 protrudes downward to a position under the valve housing 137. An upper end of the lower arm 120*b* is arranged being opposed to a push button 136 protruding downward to a position under the stop valve 131.

As shown in FIGS. 11 and 12, there is provided the screw feeding cylinder unit 132 on one side of the magazine 103. There is provided a piston rod 140 capable of sliding in a screw feeding cylinder 139. There is provided a feeding claw 141 at an end of the piston rod 140 protruding outside. The feeding claw 141 is pushed by a spring so that it can be protruded forward. The feeding claw 141 is withdrawn by the action of compressed air fed from the blow-back chamber 113, and the feeding claw 141 is advanced by the action of exhaust of the above compressed air, so that the screw 105 to be driven accommodated in the magazine 103 can be fed to the shooting section 104. At the end of the piston rod 140, there are provided a feed claw 141 and a stopper plate 142. It is arranged in such a manner that the stopper plate 142 is engaged with an upper end 122a of the lower head portion 122 of the contact arm 120 when the feed claw 141 is located at a front end position. Due to the above arrangement, when the stopper plate 142 is located at the front position, the contact arm 120 is moved to a position where the head portion 122 of the contact arm engages with the stopper plate 142, which will be referred to as a first stage movement. When the stopper plate 142 is withdrawn, the contact arm 120 is moved to a position above the stopper plate 142, which will be referred to as a second stage movement. It is arranged that the upper end of the lower arm 120*b* pushes the push button 136 of the stopper valve 131 in the second stage movement.

The screw 105 is driven by the above screw driving and turning machine as follows. First, as shown in FIG. 13, the head portion 122 at the lower end of the contact arm 120 is pressed against the material 143 to be screwed. Due to the foregoing, the lower arm 120*b* is relatively moved upward with respect to the body 101 while the lower arm 120*b* resists a spring force generated by the first spring 123. At this time, the stopper plate 142 of the screw feeding cylinder unit 132 is located at the front position. Therefore, the contact arm 120 is stopped in the first stage movement. Since the upper arm 120*a* is integrally moved upward together with the lower arm 120*b* by a spring force generated by the second spring 126, the upper end of the upper arm 120*a* pushes up the helical spring 128 of the trigger lever 109, so that the operation plate 129 can be turned. When the trigger lever 109 is pulled after that, the trigger valve 10 in FIG. 11 is effectively pushed in for the first time, so that the driving mechanism of the screw driving and turning machine is operated, and the screw 105 accommodated in the shooting section 104 is driven. In this way, a portion of the screw 105 is driven into the material 143 into which the screw is driven. Successively, the air motor 114 is operated by a signal sent when the driving mechanism is operated. Therefore, the drive gear 118 is turned, and the bit 108 used for rotation is turned. Therefore, the screw 105 to be driven is screwed into the material 143.

Figure 14:
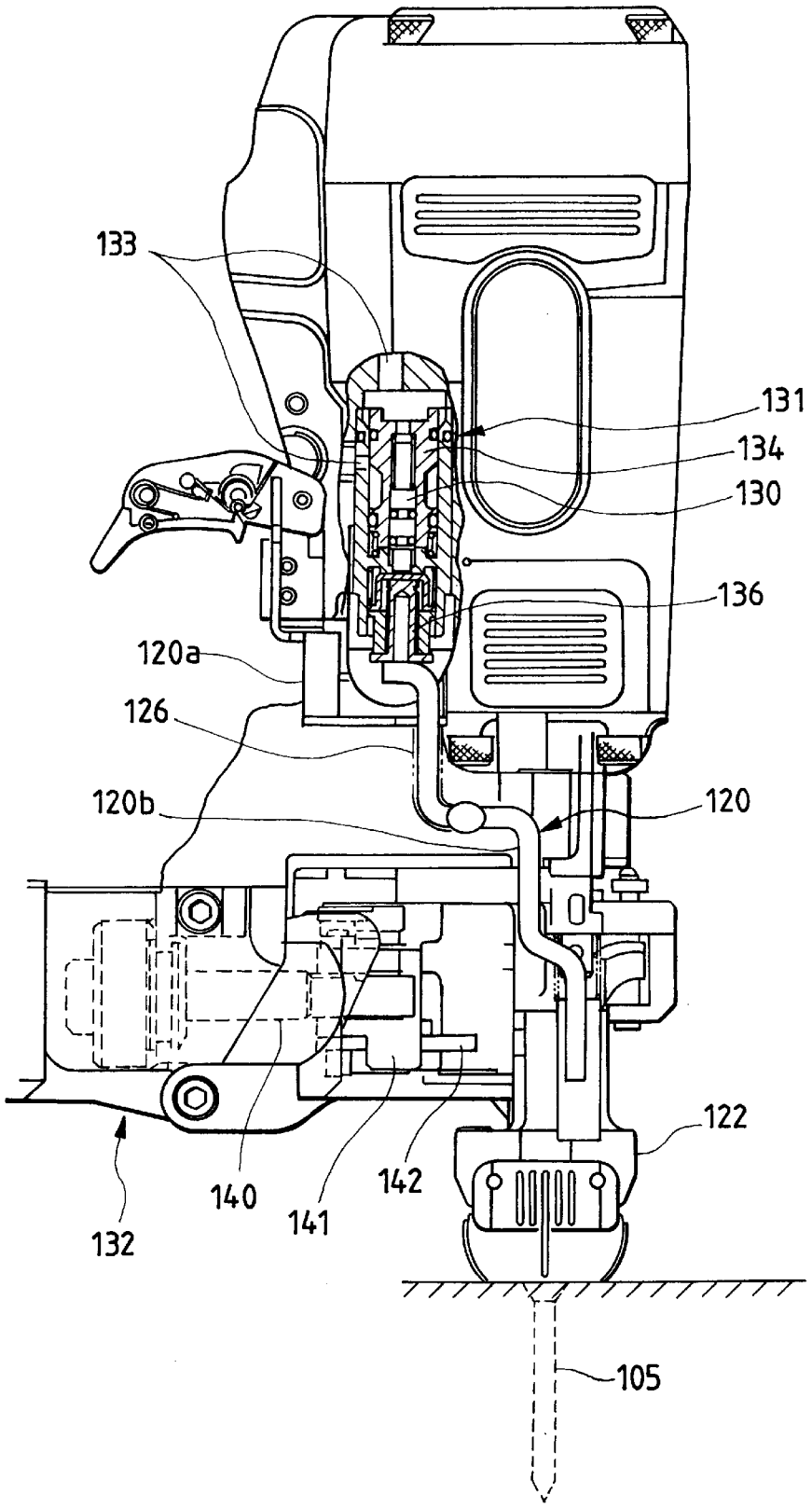
FIG. 14 is a schematic illustration showing the operation of the contact arm in the second stage movement.

When the driving mechanism is operated, the compressed air on the lower surface side of the driving piston 107 is fed into the blow-back chamber 113. Therefore, the blow-back chamber 113 is filled with the compressed air. The compressed air passes in a pipe not shown in the drawing. A portion of the compressed air operates the air motor 114, and the other portion of the compressed air is fed to the screw feeding cylinder unit 132 as shown in FIG. 14, so that the feeding claw 141 can be operated. Due to the foregoing, the stopper plate 142 is withdrawn. Therefore, the stopper plate 142 is disengaged from the head portion 122 of the contact arm 120. Accordingly, the contact arm 120 transfers to the second stage movement. As the screw 105 is screwed into the material to be screwed, the lower arm 120*b* is relatively moved upward while the lower arm 120*b* resists a spring force generated by the second spring 126. At this time, the upper arm 120*a* is not moved upward. When the screw 105 is screwed into the material by a predetermined depth, the upper end of the lower arm 120*b* pushes the push button 136 of the stop valve 131, so that the valve stem 130 of the stop valve 131 is pushed in and the air in the space 144 (shown in FIG. 13) is discharged. Therefore, the valve 134 is moved downward. Due to the foregoing motion, the air feed passage 133 from the air chamber 112 to the air motor 114 is shut off, so that the operation of the air motor is stopped. In this way, the screwing operation is completed.

After that, when the screw driving and turning machine is separated from the material 143 to be screwed and the trigger lever 109 is released, the contact arm 120 is integrally moved to the initial position with respect to the body 101, and the valve stem 135 of the stop valve 131 is lowered by the action of the spring. Since compressed air is stored in the aforementioned space 144, the valve 134 is moved upward by the action of the compressed air, so that the valve 134 is returned to a state shown in FIG. 11. Simultaneously, in accordance with the discharge of compressed air from the blow-back chamber 113, the spring force becomes superior, so that the feeding claw 141 of the screw feeding cylinder unit 132 advances forward. In this way, the screw driving and turning machine is put into the state shown in FIG. 11.

As described above, the contact arm 120 is divided into two portions. The overall contact arm 120 is integrally moved in the first stage movement, however, only the lower arm portion 120*b* is moved in the second stage movement while the upper arm portion 120*a* is not moved. Accordingly, it is possible to prevent the entire length of the screw driving and turning machine from extending.

Since the upper arm portion 120*a* is not operated in the second stage movement, it is possible to uphold the trigger lever 109 at a predetermined position.

In this connection, it should be noted that the screw turning mechanism is not limited to the air motor 114. As long as the screw 105 to be driven can be turned, any other mechanism may be adopted. Accordingly, the lower arm portion 120*b* is not limited to the specific structure by which the stop valve 131 is operated to open and close the air feed passage 133.

Figure 15:
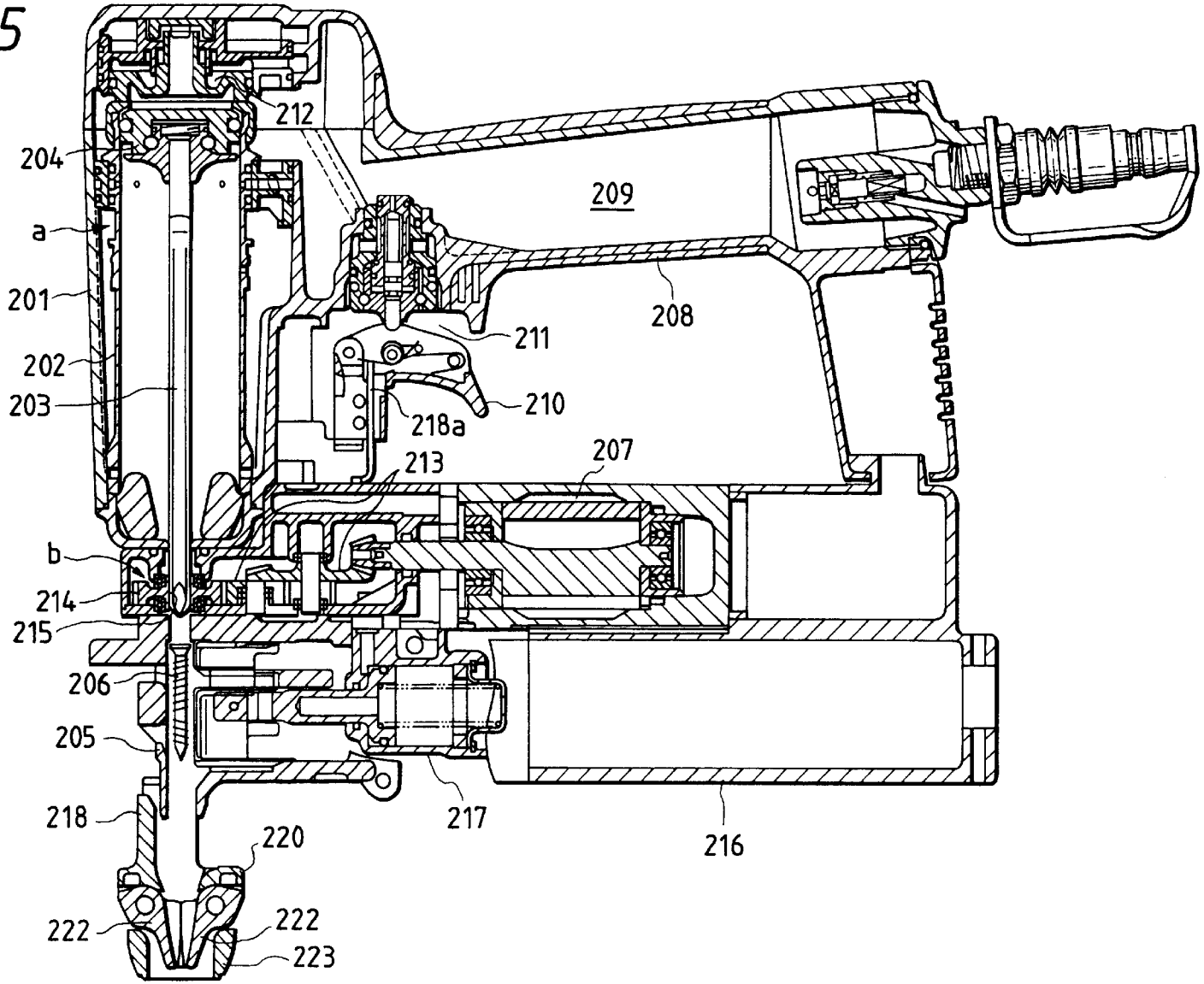
FIG. 15 is a longitudinal cross-sectional view of a still another driving and turning machine of the present invention.

FIG. 15 is an arrangement view showing a screw driving and turning machine according to another aspect of the invention. This driving and turning machine is composed as follows. In the driving cylinder 202 accommodated in the body 201, there is provided a driving piston 204 having a bit 203 used for driving and turning a screw, wherein the driving piston 204 is capable of sliding freely in the upward and downward direction in the driving cylinder 202. The driving piston 204 is driven when compressed air is fed into the driving cylinder 202. There is provided a screw driving mechanism "a" for driving the screw 206 in the nose portion 205 arranged at an end of the body 201. Also, there is provided a screw turning mechanism "b" for turning the screw 206, which has been driven by the above driving piston 204, by an air motor 207 driven by a portion of compressed air fed to the driving cylinder 202.

In this connection, compressed air is fed from a compressed air feeding source into the driving cylinder 202 via the air chamber 209 formed between the grip 208 and the body 201.

The driving mechanism "a" is set in motion when the trigger lever 210 is pulled. That is, the operation is conducted as follows. The trigger valve 211 is operated by the trigger lever 210. The head valve 212 is opened upward being linked with the trigger valve 211, so that the compressed air of high pressure in the air chamber 209 is instantaneously fed into the driving cylinder 202 so as to drive the driving piston 204. One portion of the screw 206 driven by the driving mechanism "a" is driven into a material to be driven, and the other portion of the screw 206 is left outside the material. Further, the screw 206 is turned by the screw turning mechanism "b".

The screw turning mechanism "b" operates as follows. Turn of the output shaft of the air motor 207 is transmitted to a drive gear 214 via an intermediate gear 213. Therefore, it is possible to turn the bit 203 which is inserted into a non-circular through-hole 215 formed at the center of the drive gear 214. The air motor 207 and the driving cylinder 202 are connected with each other by an air passage (not shown in the drawing), and the air motor 207 is turned by the action of compressed air fed into the driving cylinder 202. In this connection, the bit 203 can be freely slid with respect to the drive gear 214 in the axial direction and turned together with the drive gear 214.

Screws 206 to be driven are formed into a coil-shape by a connecting member and accommodated in the magazine 216. The screws 206 are fed one by one into the nose portion 205 by the screw feeding air cylinder unit 217.

Reference numeral 218 is a contact arm. In the same manner as the contact arm of the afore-mentioned, this contact arm 218 is capable of sliding along the nose portion 205. When an end portion of the contact arm 218 is pressed against a material into which the screw is driven, the contact arm 218 is pushed to the body 201 side. In other words, the contact arm 218 relatively moves upward. When the contact arm 218 is pushed in, an upper end 218*a* of the contact arm 218 moves upward, so that a pulling operation of the trigger lever 210 can be made effective, that is, the trigger valve 211 can be made to operate. The safety device of the trigger valve 211 can be composed in this way. The contact arm 218 is once locked in the middle of its movable range so that the screw 206 can be driven under the condition that the head portion of the screw 206 is raised. Immediately before the operation of the screw turning mechanism "b", the lock of the contact arm 218 is released and the contact arm 218 is moved upward so that the screw 206 can be turned and screwed.

Figure 16:
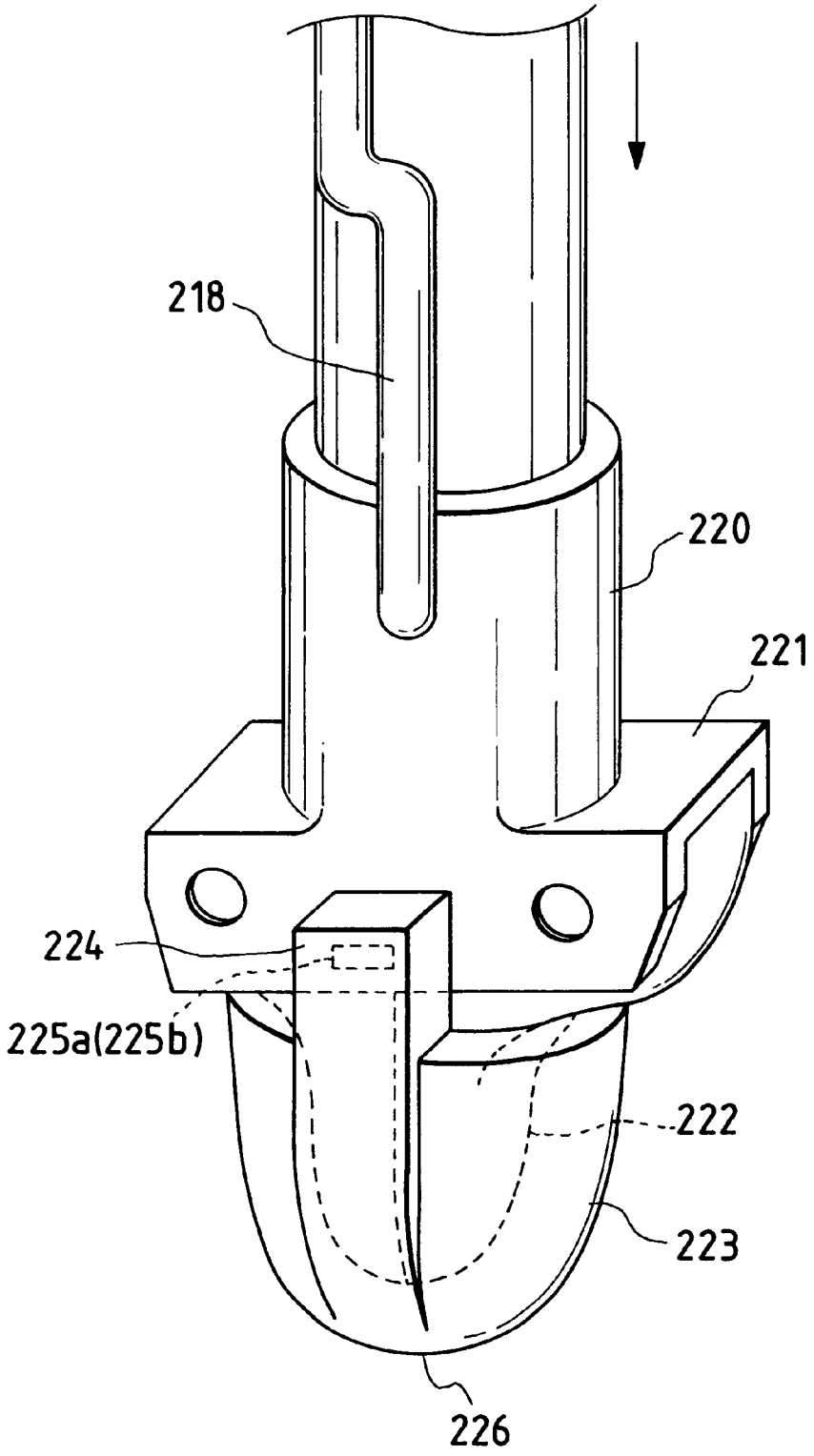
FIG. 16 is a perspective view of the screw guide mechanism illustrating its primary construction.

As shown in FIGS. 15 and 16, at a lower portion of the contact arm 218, there is formed a cylindrical portion 220. At the end of the cylindrical portion 220, there is a formed a C-shaped chuck holder 221. Inside the C-shaped chuck holder 221, there are provided a pair of guide chucks 222 which can be freely opened and closed. The guide chucks 222 guide the screw 206 to be driven, which has been driven from the nose portion 205, in the extending direction of the bit 203. These guide chucks 222 are pushed by a spring in a closing direction at all times. When the bit 203 has reached the lower dead point by the operation of the driving mechanism "a", an end of the bit 203 is located inside the guide chucks 222.

At the end of the chuck holder 221 attached to the contact arm 18, there is detachably provided a contact top 223 made of rubber or synthetic resin for protecting the material 219 into which the screw 206 is driven. The contact top 223 is formed into a short cylinder, and engaging pieces 224 are provided on both sides of the contact top 223. There are provided a protrusion 225*a* and a groove 225*b*, which are engaged with each other, on the reverse sides of this engaging pieces 224 and also on the side of the chuck holder 221. The contact top 223 can be engaged and disengaged when the engaging pieces 224 are engaged and disengaged using the protrusion 225*a* and the groove 225*b*. At the end of the contact top 223, there is provided a contact portion 226, which comes into contact with the material 219 into which the screw 206 is driven, in such a manner that the contact portion 226 protrudes to a position more distant than the guide chuck 222. The guide chuck 222 can be opened and closed inside the contact top 223.

Figure 17:
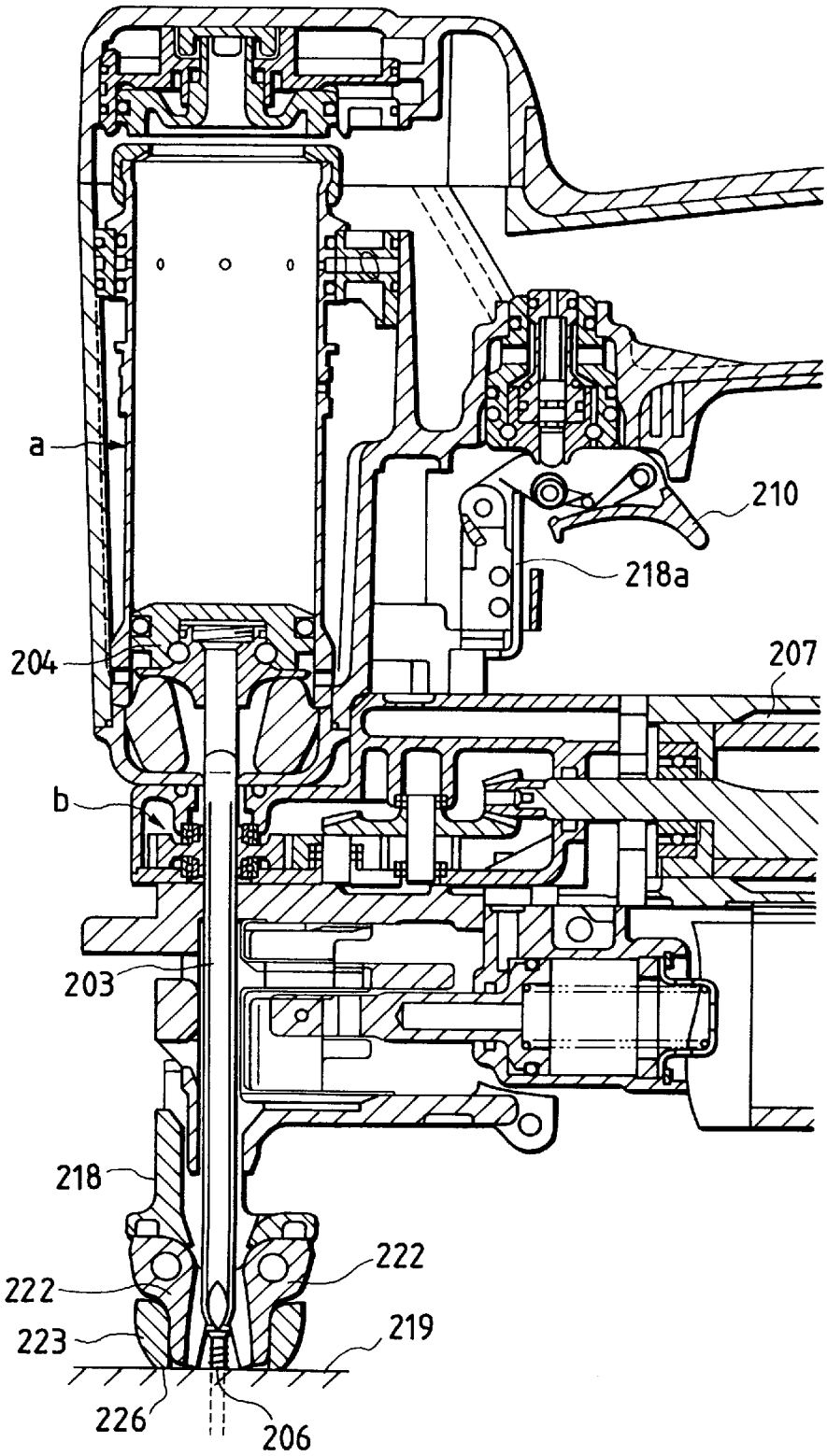
FIG. 17 is a schematic illustration showing a mode of operation of the above driving and turning machine.
Figure 18:
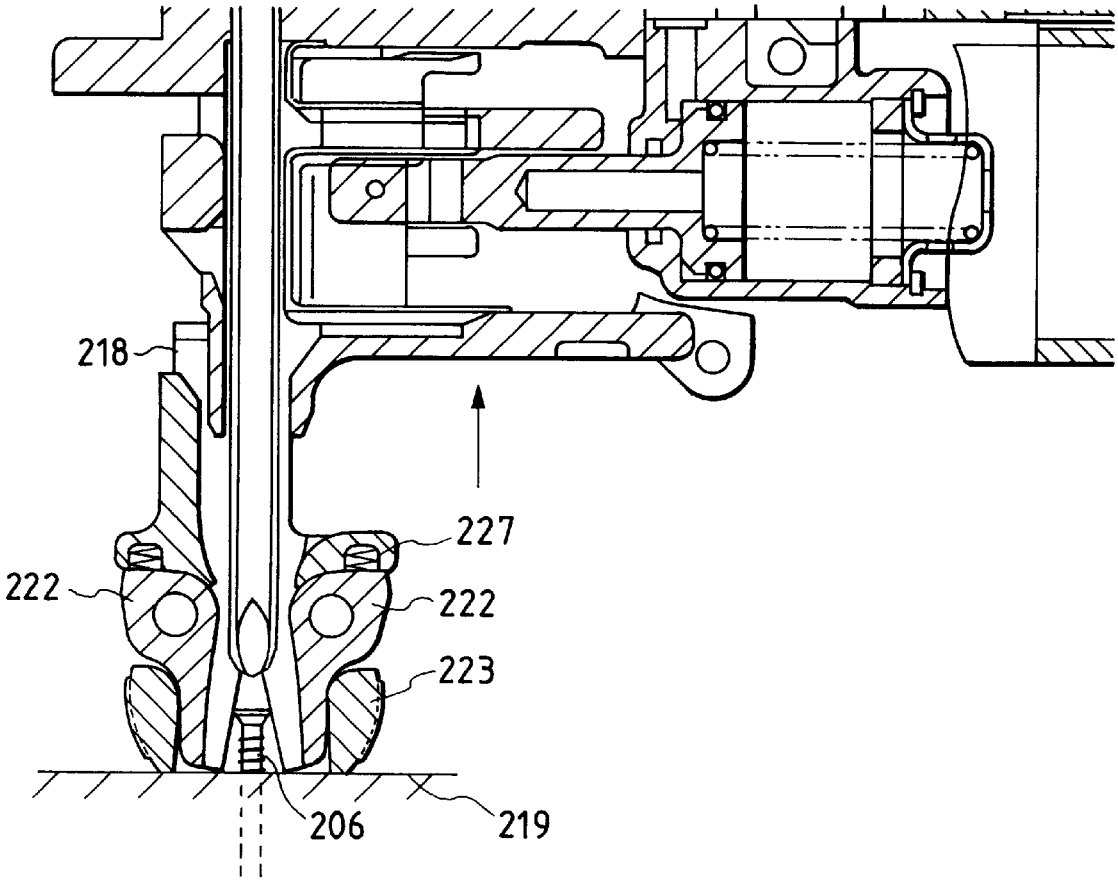
FIG. 18 is a schematic illustration showing a mode of operation of the above screw guide mechanism.
Figure 19:
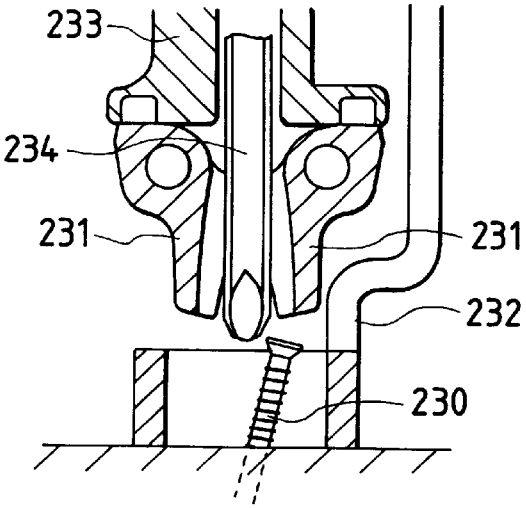
FIG. 19 is a schematic illustration showing a conventional screw guide mechanism.

According to the screw guide mechanism described above, the screw driving operation is conducted as follows. When the driving and turning machine is operated, as shown in FIG. 17, the contact portion 226 at the end of the contact top 223 attached to the end of the contact arm 218 is made to come into contact with and pressed against the material 219 into which the screw 206 is driven. Due to the foregoing operation, the contact arm 218 is relatively moved upward. Therefore, the pulling operation of the trigger lever 210 is made to be effective, and the driving mechanism "a" is set in motion and the bit 203 drives one of the screws 206 which have been fed to the nose portion 205. After the screw 206 has been driven, it is guided by the guide chucks 222 in the extending direction of the bit 203. In this way, the screw 206 is driven into the material 219. When the driving mechanism "a" is operated, the body 201 is raised by its reaction. However, as shown in FIG. 18, the contact arm 218 is slid relatively downward and contacted with the material 219 via the contact top 223. Accordingly, the guide chucks 222 are not raised, and the screw 206 to be driven can be held inside the guide chuck 222. Therefore, the bit 203 can be positively engaged with the groove of the head of the screw 206 after the completion of driving. Consequently, when the screw turning mechanism "b" is set in motion, the screw 206 can be positively turned by the bit 203 and screwed into the material 219.

Since the contact top 223 having the contact portion 226 to come into contact with the material 219 is provided at the end of the contact arm 218, the end portions of the guide chucks 222 are not directly contacted with the material 219 into which the screw 206 is driven. Accordingly, when the screw 206 is driven into the material 219 by the driving mechanism "a", the guide chucks 222 are operated and opened while they resist a spring force generated by the spring 227. This opening operation can be conducted smoothly, and the material 219 into which the screw 206 is driven can be effectively prevented from damaging in the process of opening the guide chucks 222.

In this connection, the contact top 223 is quickly consumed. However, it can be freely attached to and detached from the contact arm 218. Therefore, replacement of the contact top 223 can be easily conducted.

Figure 20:
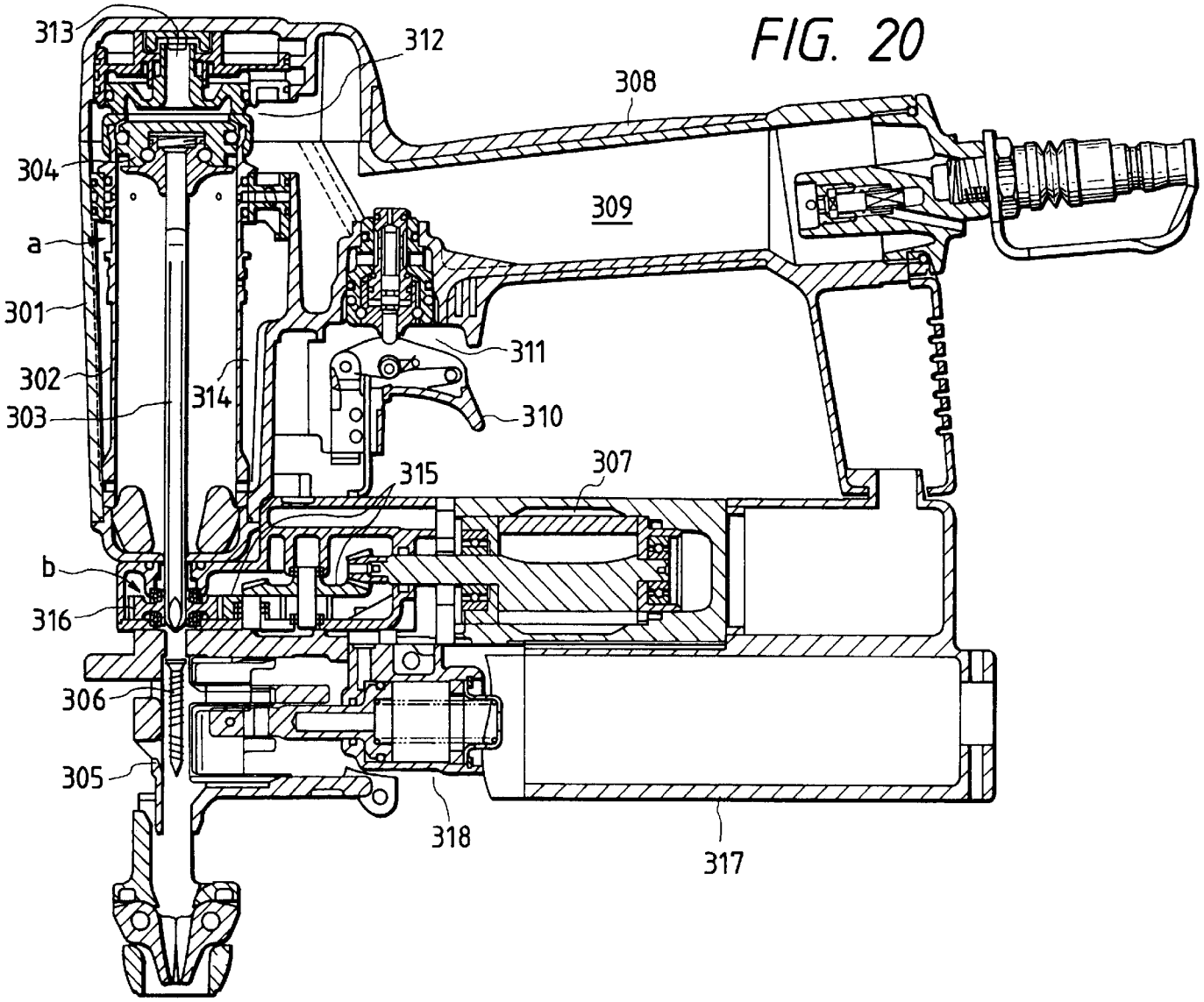
FIG. 20 is a longitudinal cross-sectional view of a still further driving and turning machine according to the present invention.

FIG. 20 is an arrangement view showing a screw driving and turning machine according to still further aspect of the invention. This driving and turning machine is composed as follows. In the driving cylinder 302 accommodated in the body 301, there is provided a driving piston 304 having a bit 303 used for driving and turning a screw, wherein the driving piston 304 is capable of sliding freely in the upward and downward direction in the driving cylinder 302. The driving piston 304 is driven when compressed air is fed into the driving cylinder 302. There is provided a screw driving mechanism "a" for driving the screw 306 in the nose portion 305 arranged at an end of the body 301. Also, there is provided a screw turning mechanism "b" for turning the screw 306, which has been driven by the above driving piston 304, by an air motor 307.

In this connection, compressed air is fed from a compressed air feeding source (not shown in the drawing) into the driving cylinder 302 via the air chamber 309 formed between the grip 308 and the body 301.

Figure 21:
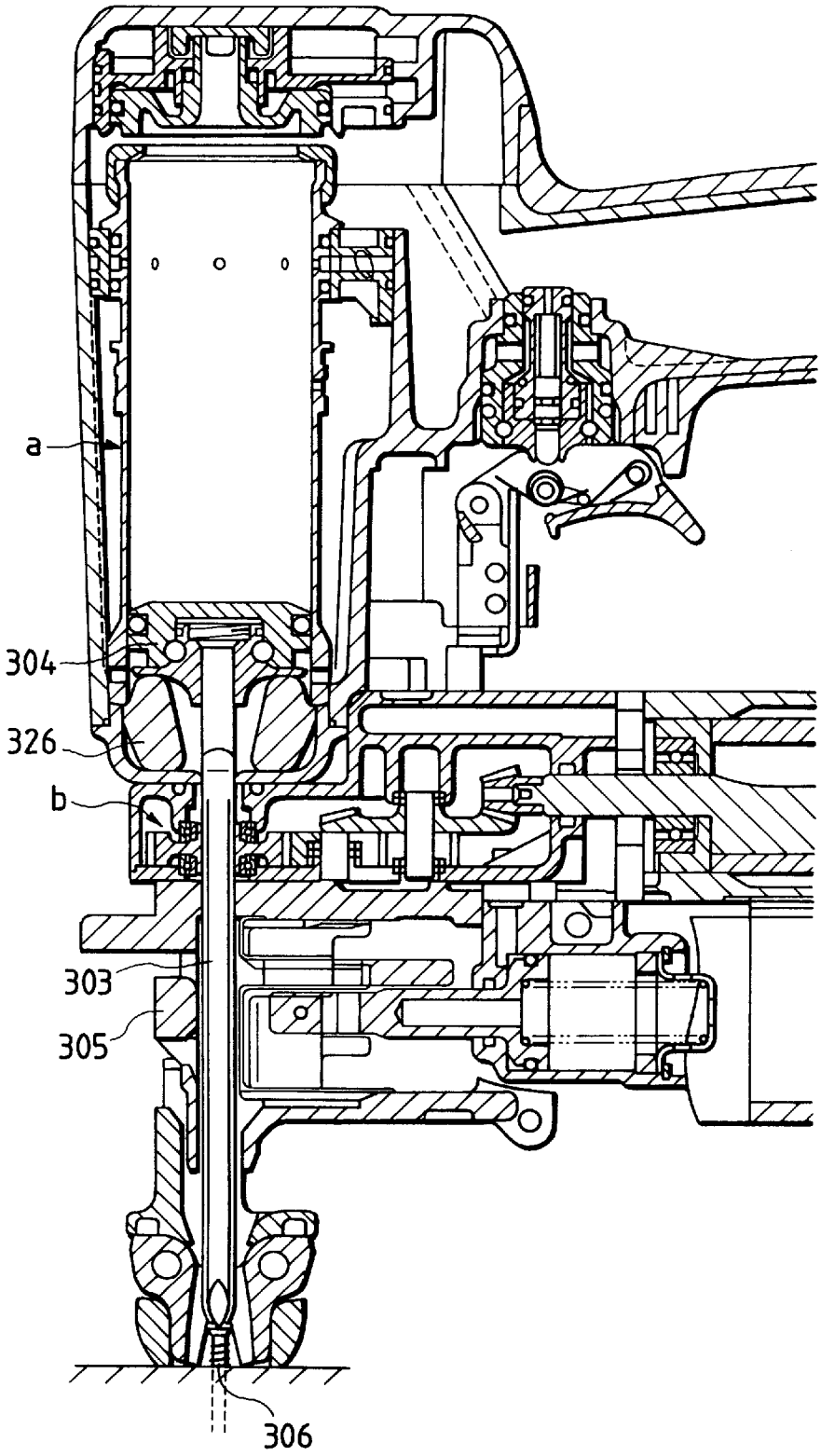
FIG. 21 is a schematic illustration for explaining the operation of the driving mechanism of the above driving and turning machine.

The driving mechanism "a" is set in motion when the trigger lever 310 is pulled. That is, the operation is conducted as follows. The trigger valve 311 is operated by the trigger lever 310. The head valve 312 is opened upward being linked with the trigger valve 311, so that the compressed air of high pressure in the air chamber 309 is instantaneously fed into the driving cylinder 302 so as to drive the driving piston 304. Due to the foregoing, as shown in FIG. 21, one portion of the screw 306 driven by the driving mechanism "a" is driven into a material into which the screw is driven, and the other portion of the screw 306 is left outside the material.

On the other hand, when the trigger lever 310 is released, the trigger valve 311 operates the head valve 312 in such a manner that the driving cylinder 302 is closed from the air chamber 309, and the driving cylinder 302 is open to the exhaust valve 313. Accordingly, the pressure on an upper surface of the driving piston 304 is reduced, and the pressure on a lower surface of the driving piston 304 is increased by the action of compressed air stored in the blowback chamber 314 which has been compressed by the driving piston 304 in the process of driving. In this way, a differential pressure is caused between a space on the upper surface of the driving piston 304 and a space on the lower surface. Therefore, the driving piston 304 returns to the upper dead point.

The screw turning mechanism "b" operates as follows. Turn of the output shaft of the air motor 307 is transmitted to the drive gear 316 via the intermediate gear 315. Therefore, it is possible to turn the bit 303 which is inserted into a non-circular through-hole formed at the center of the drive gear 316. The bit 303 is inserted into the drive gear 316 in such a manner that the bit 303 can be freely slid in the axial direction of the drive gear 316 and turned together with the drive gear 316. The air motor 307 may be driven by utilizing a portion of the compressed air fed into the driving cylinder 302.

Screws 306 to be driven are formed into a coil-shape by a connecting member (not shown) and accommodated in the magazine 317. The screws 306 are fed one by one into the nose portion 305 by the screw feeding cylinder unit 318.

Figure 22:
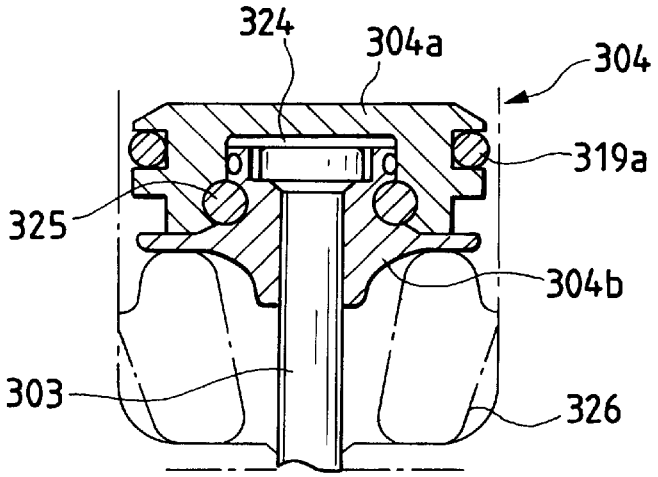
FIG. 22 is a cross-sectional view of the piston structure of the above nailing machine illustrating its primary portion.
Figure 23:
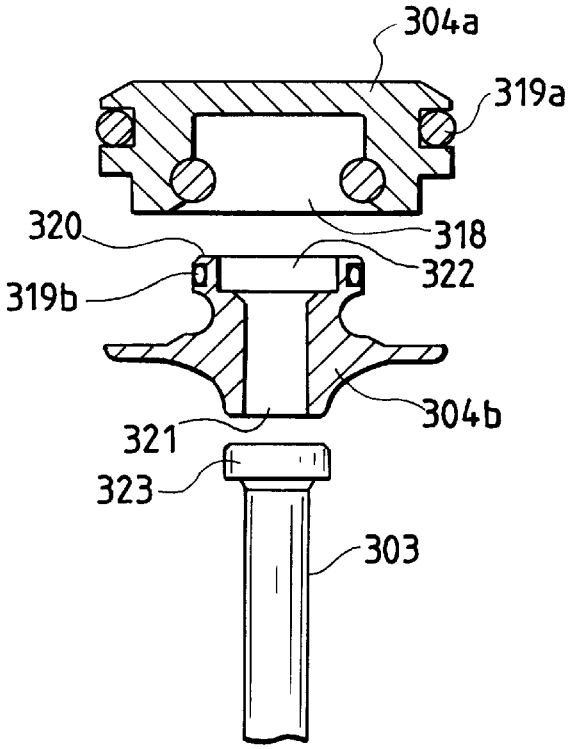
FIG. 23 is an exploded view of the primary portion of the above nailing machine.
Figure 24A:
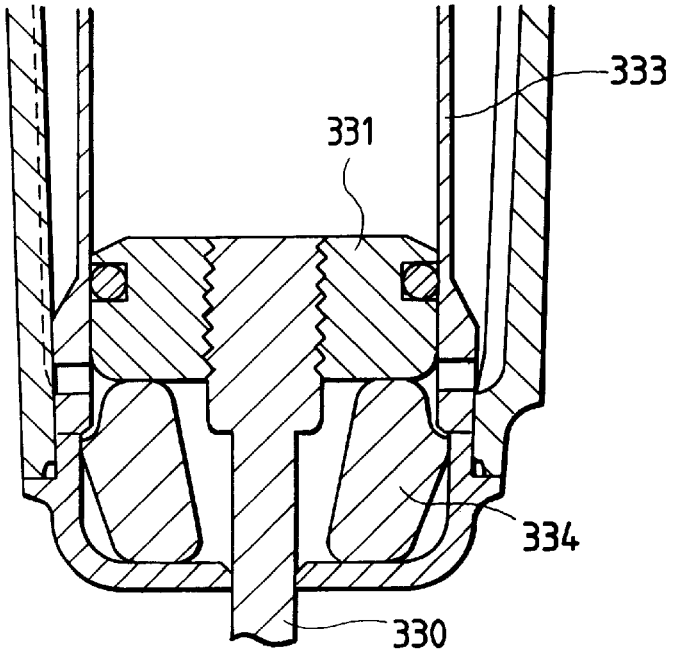
FIGS. 24(*a*) and 24(*b*) are cross-sectional views of the conventional piston structure illustrating its primary portion.
Figure 24B:
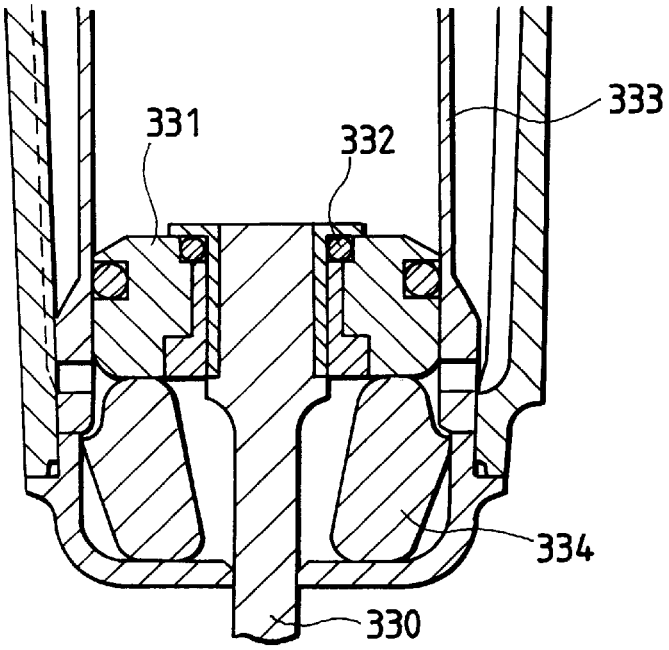

In this connection, as shown in FIGS. 22 and 23, the driving piston 304 composing the driving mechanism "a" is made so that it can be divided into an upper piston member 304*a* and a lower piston member 304*b*. At the center on the lower surface of the upper piston member 304*a*, there is formed a recess 318. On the outer circumferential surface of the upper piston member 304*a*, there is provided an O-ring 319*a*. At the center on the upper surface of the lower piston member 304*b*, there is formed a protrusion 320 which engages with the above recess 318. At the center of the lower piston member 304*b*, there is formed a through-hole 321 through which the bit 321 penetrates. In the upper portion of the through-hole 321, there is formed a large diameter flange receiving portion 322. On the outer circumferential surface of the protrusion 320, there is provided an O-ring 319*b*.

The lower end portion of the bit 303 is formed into an appropriate shape to engage with a groove formed in the head portion of the screw 306 to be driven. At the upper end portion of the bit 303, there is formed a flange 323 protruding outside.

The bit 303 penetrates the through-hole 321 of the lower piston member 304*b*, and the flange 323 of the bit 303 is accommodated in the receiving portion 322 of the lower piston member 304b. Under the above condition, the protrusion 320 of the lower piston member 304*b* is engaged with the recess 318 of the upper piston member 304*a*. The flange 323 of the bit 303 is arranged in a space formed by a bottom surface of the recess 318 of the upper piston member 304*a* and the receiving portion 322 of the protrusion 320 of the lower piston member 304*b* via a washer 324 which is used to prevent the upper piston member 304*a* from wearing away. The upper piston member 304*a* and the lower piston member 304*b* are connected with each other by fixing pins 325. While the bit 303 is supported with respect to the driving piston 304 by the through-hole 321 formed in the lower piston member 304*b*, the bit 303 is capable of turning freely round the axial center.

According to the above piston structure, the compressed air of high pressure fed into the driving cylinder 302 in the process of driving acts on the upper surface of the driving piston 304, and then the lower surface of the driving piston 304 comes into contact with the bumper 326. In this way, the upper and the lower surface of the driving piston 304 are given high resisting forces. However, the compressed air is received by the upper surface of the upper piston member 304*a*, so that the bit 303 itself is not given an action of the compressed air. Further, the rotational resistance of the driving piston 304 does not affect the turn of the bit 303. Accordingly, when the bit 303 is turned by the turning mechanism, it can be turned even if a small turning force is given. Therefore, it is possible to reduce the driving torque to drive the bit 303.

In the above arrangement, the bit 303 is attached to the piston without using a bearing. Accordingly, the structure is simple, and the manufacturing cost can be reduced.

Further, the upper piston member 304*a* and the lower piston member 304*b* can be easily separated from each other when the fixing pins 325 are pulled out from the piston. Therefore, when the bit 303 has worn away, it is possible to replace it with a new one.

It should be noted that the above piston structure can be applied to not only the above driving and turning machine by which a screw is driven but also a pneumatic nailing machine by which a common nail is driven. In this case, the bit is replaced with a driver, and it is not necessary for this driver to be freely turned with respect to the driving piston.

What is claimed is:

1. A screw driving and turning machine adapted to be attached to a source of compressed air for driving and turning a screw into a receiving material comprising:

a body having a nose portion adapted to hold a screw;

a driving cylinder received in said body;

a driving piston slidably received in said driving cylinder, a screw driving mechanism having a driving and turning bit slidably received in said driving cylinder, wherein said driving cylinder is adapted to receive compressed air to drive said driving piston and said driving and turning bit to drive said screw partially into the receiving material;

a screw turning mechanism having an air motor, said air motor being driven by a portion of with compressed air supplied to the driving cylinder to turn said screw after said screw has been partially driven into the receiving material;

a stop valve for opening and closing an air passage between said driving cylinder and said air motor, said stop valve being disposed within said air passage; and means for operating said stop valve to open and close said air passage, said means being slidably arranged along said nose portion, wherein said means is operable to close said stop valve to stop the feed of compressed air from said driving cylinder to said air motor when said means for operating said stop valve is pushed to a predetermined position along said nose portion by the pressing of said nose portion against the receiving material.

2. The screw driving and turning machine according to claim 1, wherein said means for operating said stop valve comprises a contact arm, said contact arm including an upper arm portion and a lower arm portion, said contact arm adapted for movement along said nose portion wherein during the driving of said screw said upper and said lower arm portions are integrally moved along said nose portion, and during the turning of the screw only said lower arm portion is moved along said nose portion.

3. The screw driving and turning machine according to claim 1, further comprising:

means for adjusting a distance between said means for operating said stop valve and said stop valve, said means for adjusting being arranged between said means for operating said stop valve and said stop valve.

4. The screw driving and turning machine according to claim 1, further comprising:

a guide chuck disposed in said nose portion proximate said driving and turning bit, said guide chuck adapted to guide said screw to be driven; and a material contact portion for contacting the receiving material into which said screw is driven, said material contact portion being disposed at an end of said guide chuck.

5. A screw driving and turning machine adapted to be attached to a source of compressed air for driving and tuning a screw into a receiving material comprising:

a body having a nose portion adapted to hold a screw;

a driving cylinder received in said body;

a driving piston slidably received in said driving cylinder;

a screw driving mechanism having a driving and turning bit slidably received in said driving cylinder and engageable with said driving piston, wherein said driving cylinder is adapted to receive compressed air to drive said driving piston and said driving and turning bit to drive said screw partially into the receiving material;

a screw turning mechanism having an air motor, said air motor being driven by a portion of the compressed air supplied to the driving cylinder to turn said screw after said screw has been partially driven into the receiving material;

a stop valve selectively changeable between an open state in which compressed air is supplied from said driving cylinder to said air motor and a closed state in which compressed air is not supplied to said air motor;

a guide chuck disposed in said nose portion proximate said driving and turning bit, said guide chuck adapted to guide said screw to be driven;

a material contact portion for contacting the receiving material into which said screw is driven, said material contact portion being disposed at an end of said guide chuck; and a contact arm slidably arranged along said nose portion, wherein said contact arm is operable to change said stop valve from said open state to said closed state when said contact arm is pushed to a predetermined position along said nose portion by pressing said material contact portion against the receiving material.

6. The screw driving and turning machine according to claim 5, wherein said guide chuck is pivotally disposed in the nose portion and material contact portion allows for said guide chuck to pivot therein.

7. The screw driving and turning machine according to claim 5, further comprising:

means for adjusting a distance between said contact arm and said stop valve, said means for adjusting being arranged between said contact arm and said stop valve.

8. The screw driving and turning machine according to claim 5, wherein said stop valve is disposed within an air passage located between said driving cylinder and said air motor.

* * * * *

UNITED STATES PATENT AND TRADEMARK OFFICE

CERTIFICATE OF CORRECTION

PATENT NO. : 5,921,156

DATED : July 13, 1999

INVENTOR(S) : Takezaki et al.

It is certified that error appears in the above-identified patent and that said Letters Patent is hereby corrected as shown below:

Column 16, line 36, change "tuning" to --turning--.

Signed and Sealed this

Fourth Day of April, 2000

*Attest:*

*Attesting Officer*

Q. TODD DICKINSON

*Director of Patents and Trademarks*